US008919306B2

(12) United States Patent
Nakashima

(10) Patent No.: US 8,919,306 B2
(45) Date of Patent: Dec. 30, 2014

(54) CONTROLLER FOR VARIABLE VALVE DEVICE

(75) Inventor: Toyokazu Nakashima, Mie-ken (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/548,601

(22) Filed: Jul. 13, 2012

(65) Prior Publication Data

US 2013/0019826 A1 Jan. 24, 2013

(30) Foreign Application Priority Data

Jul. 19, 2011 (JP) ..... 2011-158199

(51) Int. Cl.
*F01L 1/34* (2006.01)
*F01L 1/18* (2006.01)
*F01L 1/344* (2006.01)

(52) U.S. Cl.
CPC ..... *F01L 1/3442* (2013.01); *F01L 2001/34476* (2013.01); *F01L 2800/05* (2013.01); *F01L 2001/34466* (2013.01); *F01L 2001/34469* (2013.01); *F01L 1/185* (2013.01)
USPC ..... 123/90.15; 123/90.17; 464/160

(58) Field of Classification Search
USPC ..... 123/90.15, 90.17; 464/160
See application file for complete search history.

(56) References Cited

U.S. PATENT DOCUMENTS

| | | | | |
|---|---|---|---|---|
| 6,684,835 | B2 * | 2/2004 | Komazawa et al. | 123/90.17 |
| 6,802,286 | B2 * | 10/2004 | Fujiwara et al. | 123/90.15 |
| 6,885,976 | B2 * | 4/2005 | Yoshiki et al. | 702/185 |
| 7,213,554 | B2 * | 5/2007 | Kanada et al. | 123/90.17 |

FOREIGN PATENT DOCUMENTS

| | | | |
|---|---|---|---|
| JP | 05-156972 | A | 6/1993 |
| JP | 11-210424 | A | 8/1999 |
| JP | 2001-164953 | A | 6/2001 |
| JP | 2001164908 | A | 6/2001 |
| JP | 2003-239773 | A | 8/2003 |
| JP | 2009156217 | A | 7/2009 |

* cited by examiner

*Primary Examiner* — Ching Chang
(74) *Attorney, Agent, or Firm* — Gifford, Krass, Sprinkle, Anderson & Citkowski, P.C.

(57) ABSTRACT

A controller for a variable valve device of an internal combustion engine includes a hydraulic valve timing changing mechanism that changes the valve timing VT of an intake valve, a valve timing locking mechanism that locks the valve timing VT to an intermediate phase, and an electronic controller that controls the operation of the valve timing changing mechanism. The electronic controller limits the variable range of the valve timing VT in accordance with the composition of hydraulic oil, when the operational state of the valve timing changing mechanism is a phase-unlocked state in which the valve timing VT can be changed.

6 Claims, 10 Drawing Sheets

CONTROLLER FOR VARIABLE VALVE DEVICE

CROSS REFERENCE TO RELATED APPLICATIONS

This application claims priority to Japanese Patent Application No. 2011-158199 filed on Jul. 19, 2011, which including the specification, drawings and abstract is incorporated herein by reference in its entirety including the specification, drawings and abstract.

BACKGROUND OF THE INVENTION

1. Field of the Invention

The invention relates to a controller for a variable valve device (hereinafter, also referred to as "variable valve device controller") of an internal combustion engine, the variable valve device including a hydraulic phase changing mechanism that changes valve timing, and a phase locking mechanism that locks the valve timing to a specific phase. More specifically, the invention relates to a variable valve device controller that controls the operation of the phase changing mechanism.

2. Description of Related Art

In a variable valve device controller described in Japanese Patent Application Publication No. 11-210424 (JP 11-210424 A), from the viewpoint of the stability of feedback control of valve timing, the valve timing is locked to a specific phase by a phase locking mechanism when the temperature of hydraulic oil in a phase changing mechanism is low. That is, when the temperature of hydraulic oil in the phase changing mechanism is low, the controller executes a control to limit the operation of the phase changing mechanism.

When the operating speed of the phase changing mechanism is compared between a case where a kind of hydraulic oil with high viscosity is used and a case where a kind of hydraulic oil with low viscosity is used, assuming that the hydraulic oil temperature and the engine speed are the same between the two cases, the operating speed is lower in the former case than in the latter case owing to the greater resistance acting on the hydraulic oil with the higher viscosity. That is, the operating speed of the phase changing mechanism varies under the influence of not only the temperature of hydraulic oil but also the viscosity of hydraulic oil based on the difference in the kind of hydraulic oil or the like.

The variable valve device controller described in JP 11-210424 A limits the operation of the phase changing mechanism indiscriminately when the temperature of hydraulic oil is low. Accordingly, it is not allowed to change the valve timing even when a low viscosity kind of hydraulic oil is used, in other words, even when the influence of the viscosity of hydraulic oil on the operating speed of the phase changing mechanism is predicted to be small.

This is equivalent to a state in which even though it is allowed to change the valve timing in accordance with the engine operation state, the variable range of the valve timing is limited excessively relative to a variable range suited for the engine operation state.

While the present case is directed to locking of the operation of the phase changing mechanism by the phase locking mechanism as an example of a limitation on the operation of the phase changing mechanism, presumably, the same problem mentioned above arises as long as the variable valve device controller used is one that executes a control to limit the operation of the phase changing mechanism by taking the temperature of hydraulic oil into consideration.

SUMMARY OF THE INVENTION

In view of the above-mentioned problem, the invention provides a variable valve device controller that can ensure a greater number of situations where it is possible to change the valve timing in accordance with the engine operation state.

Thus, according to an aspect of the invention, there is provided a controller for a variable valve device of an internal combustion engine, the variable valve device including a phase changing mechanism of a hydraulic type that changes valve timing, and a phase locking mechanism that locks the valve timing to a predetermined phase. The controller includes a limiting control unit configured to execute a limiting control that limits an operation of the phase changing mechanism in accordance with a composition of hydraulic oil in the phase changing mechanism.

According to the controller configured as mentioned above, the difference in the viscosity of hydraulic oil due to the difference in the composition of hydraulic oil is reflected on the limiting control. Therefore, as compared with a case where the operation of the phase changing mechanism is limited indiscriminately in the state when the temperature of hydraulic oil is low, it is possible to ensure a greater number of situations where the valve timing can be changed in accordance with the engine operation state.

Also, the controller for a variable valve device mentioned above may be configured so that an operational state of the phase changing mechanism in which the valve timing is locked to the specific phase is defined as a phase-locked state, an operational state of the phase changing mechanism in which the valve timing can be changed is defined as a phase-unlocked state, a range over which the valve timing can be changed when the phase changing mechanism is in the phase-unlocked state is defined as a variable range, and in the limiting control, the limiting control unit limits the variable range in accordance with the composition of the hydraulic oil in the phase changing mechanism.

According to the controller configured as mentioned above, the difference in the viscosity of hydraulic oil due to the difference in the composition of hydraulic oil is reflected on the limiting of the variable range. Therefore, it is possible to ensure a greater number of situations where the valve timing can be changed in accordance with the engine operation state.

According to another aspect of the invention, there is provided a controller for a variable valve device of an internal combustion engine, the variable valve device including a phase changing mechanism of a hydraulic type that changes valve timing, and a phase locking mechanism that locks the valve timing to a predetermined phase. The controller for a variable valve device includes a limiting control unit configured to execute a limiting control that limits an operation of the phase changing mechanism, in which an operational state of the phase changing mechanism in which the valve timing is locked to the specific phase is defined as a phase-locked state, an operational state of the phase changing mechanism in which the valve timing can be changed is defined as a phase-unlocked state, a range over which the valve timing can be changed when the phase changing mechanism is in the phase-unlocked state is defined as a variable range, and in the limiting control, the limiting control unit limits the variable range in accordance with a viscosity of the hydraulic oil in the phase changing mechanism.

According to the controller configured as mentioned above, the difference in the viscosity of hydraulic oil is reflected on the limiting of the variable range. Therefore, as compared with a case where the operation of the phase changing mechanism is limited indiscriminately in the state when the temperature of hydraulic oil is low, it is possible to ensure a greater number of situations where the valve timing can be changed in accordance with the engine operation state.

Also, the controller for a variable valve device mentioned above may be configured so that a temperature of the hydraulic oil in the phase changing mechanism is defined as an oil temperature, a viscosity of the hydraulic oil in the phase changing mechanism is defined as an oil viscosity, a state in which the oil temperature is within a predetermined temperature range is defined as a predetermined oil temperature state, and in the limiting control, the limiting control unit makes a size of the variable range in the predetermined oil temperature state and when the oil viscosity is high smaller than a size of the variable range in the predetermined oil temperature state and when the oil viscosity is low.

The higher the oil viscosity, the greater the resistance of the hydraulic oil acting on the operation of the phase changing mechanism. Hence, the period of time taken to change the phase changing mechanism from the phase-unlocked state to the phase-locked state is longer when the oil viscosity is high than when the oil viscosity is low. As a result, as compared with when the oil viscosity is low and an engine stall occurs, when the oil viscosity is high and an engine stall occurs, there is a high possibility that the engine stops without the phase changing mechanism being changed to the phase-locked state.

According to the controller configured as mentioned above, the variable range when the oil viscosity is high is made smaller than the variable range when the oil viscosity is low. Thus, comparing the case when the oil viscosity is high with the case when the oil viscosity is low, the maximum difference between the valve timing and the specific phase during execution of the limiting control is smaller in the former case than in the latter case. As a result, it is possible to reduce the frequency with which the engine stops without the phase changing mechanism being changed to the phase-locked state.

Also, the controller for a variable valve device mentioned above may be configured so that the specific phase is a phase between a most retarded phase and a most advanced phase, a predetermined phase located on a retard side with respect to the specific phase within a range from the most retarded phase to the specific phase is defined as a retard-side limit phase, a range from the specific phase to the retard-side limit phase is defined as a retard-side limit range, the retard-side limit range is included in the variable range, and in the limiting control, the limiting control unit makes a size of the retard-side limit range in the predetermined oil temperature state and when the oil viscosity is high smaller than a size of the retard-side limit range in the predetermined oil temperature state and when the oil viscosity is low.

The torque of the camshaft fluctuates in the advance direction and the retard direction. Also, the torque that acts in the advance direction is greater than the torque that acts in the retard direction. For this reason, as compared with when retarding the valve timing that is on the advance side with respect to the specific phase, when advancing the valve timing that is on the retard side with respect to the specific phase, greater resistance is applied to the phase changing mechanism. As a result, in a case where the valve timing is on the retard side with respect to the specific phase when an engine stall occurs, the possibility that the engine stops without the phase changing mechanism being changed to the phase-locked state becomes higher as the difference between the valve timing and the specific phase becomes greater.

According to the controller configured as mentioned above, the retard-side limit range when the oil viscosity is high is made smaller than the retard-side limit range when the oil viscosity is low. Thus, comparing the case when the oil viscosity is high with the case when the oil viscosity is low, the maximum difference between the valve timing and the specific phase during execution of the limiting control is smaller in the former case than in the latter case. As a result, it is possible to reduce the frequency with which the engine stops without the phase changing mechanism being changed to the phase-locked state.

Also, the controller for a variable valve device mentioned above may be configured so that the specific phase is a phase between a most retarded phase and a most advanced phase, a predetermined phase located on a retard side with respect to the specific phase within a range from the most retarded phase to the specific phase is defined as a retard-side limit phase, a predetermined phase located on an advance side with respect to the specific phase within a range from the most advanced phase to the specific phase is defined as an advance-side limit phase, a range from the specific phase to the retard-side limit phase is defined as a retard-side limit range, a range from the specific phase to the advance-side limit phase is defined as an advance-side limit range, the retard-side limit range and the advance-side limit range are included in the variable range, and in the limiting control, the limiting control unit makes sizes of the retard-side limit range and the advance-side limit range in the predetermined oil temperature state and when the oil viscosity is high smaller than sizes of the retard-side limit range and the advance-side limit range in the predetermined oil temperature state and when the oil viscosity is low.

According to the controller configured as mentioned above, the retard-side limit range and the advance-side limit range when the oil viscosity is high are made smaller than the retard-side limit range and the advance-side limit range when the oil viscosity is low. Thus, comparing the case when the oil viscosity is high with the case when the oil viscosity is low, the maximum difference between the valve timing and the specific phase during execution of the limiting control is smaller in the former case than in the latter case. As a result, it is possible to reduce the frequency with which the engine stops without the phase changing mechanism being changed to the phase-locked state.

Also, the controller for a variable valve device mentioned above may be configured so that in the limiting control, the limiting control unit changes a limiting period in which the limiting control is executed, in accordance with at least one of the compositions and a viscosity of the hydraulic oil.

According to the controller configured as mentioned above, the difference in at least one of the composition and viscosity of hydraulic oil is reflected on the limiting period. Therefore, as compared with a case where the operation of the phase changing mechanism is limited indiscriminately in the state when the temperature of hydraulic oil is low, it is possible to ensure a greater number of situations where the valve timing can be changed in accordance with the engine operation state.

Also, the controller for a variable valve device mentioned above may be configured so that a temperature of the hydraulic oil in the phase changing mechanism is defined as an oil temperature, a viscosity of the hydraulic oil in the phase changing mechanism is defined as an oil viscosity, a state in which the oil temperature is within a predetermined temperature range is defined as a predetermined oil temperature state, and the limiting control unit makes the limiting period in the predetermined oil temperature state and when the oil viscosity is high longer than the limiting period in the predetermined oil temperature state and when the oil viscosity is low.

According to the controller configured as mentioned above, the limiting period when the oil viscosity is high is made longer than the limiting period when the oil viscosity is low. Thus, comparing the case when the oil viscosity is high with the case when the oil viscosity is low, the period in which the variable range is limited during execution of the limiting control is longer in the latter case than in the former case. As a result, it is possible to reduce the frequency with which the engine stops without the phase changing mechanism being changed to the phase-locked state.

According to yet another aspect of the invention, there is provided a controller for a variable valve device of an internal combustion engine, the variable valve device including a phase changing mechanism of a hydraulic type that changes valve timing, and a phase locking mechanism that locks the valve timing to a predetermined phase. The controller includes a limiting control unit configured to change at least one of a variable range and a limiting period in accordance with an operating speed of the phase changing mechanism in a predetermined oil temperature state, in which an operational state of the phase changing mechanism in which the valve timing is locked to the specific phase is defined as a phase-locked state, an operational state of the phase changing mechanism in which the valve timing can be changed is defined as a phase-unlocked state, the variable range is a range over which the valve timing can be changed when the phase changing mechanism is in the phase-unlocked state, a temperature of the hydraulic oil in the phase changing mechanism is defined as an oil temperature, the limiting period is a period in which the variable range is limited, and the predetermined oil temperature state is a state in which the oil temperature is within a predetermined temperature range.

According to the controller configured as mentioned above, the limiting control is performed in accordance with the operating speed of the phase changing mechanism on which the difference in the viscosity of hydraulic oil is reflected. Therefore, as compared with a case where the operation of the phase changing mechanism is limited indiscriminately in the state when the temperature of hydraulic oil is low, it is possible to ensure a greater number of situations where the valve timing can be changed in accordance with the engine operation state.

Also, the controller for a variable valve device mentioned above may be configured so that the limiting control unit learns the operating speed of the phase changing mechanism when the valve timing advances.

The torque of the camshaft fluctuates in the advance direction and the retard direction. Also, the torque that acts in the retard direction is greater than the torque that acts in the retard direction. For this reason, as compared with when retarding the valve timing, greater resistance is applied to the phase changing mechanism when advancing the valve timing. Thus, the difference in operating speed due to the difference in the viscosity of hydraulic oil is more easily detected at the time of advancing the valve timing than at the time of retarding the valve timing. By focusing attention to this fact, in the controller mentioned above, the operating speed is learned at the time of advancing the valve timing. As a result, the frequency with which the operating speed of the phase changing mechanism is learned appropriately increases.

Also, the controller for a variable valve device mentioned above may be configured so that the limiting control unit learns the operating speed of the phase changing mechanism when the valve timing begins to change.

According to the controller configured as mentioned above, with the state in which the speed of change of the valve timing is "0" being taken as a reference, the operating speed of the phase changing mechanism is learned in accordance with the speed of change of the valve timing from this state. Therefore, as compared with a case where the state in which the speed of change of the valve timing is fluctuating is used as a reference in learning the operating speed, the frequency with which the operating speed of the phase changing mechanism is learned appropriately increases.

Also, the controller for a variable valve device mentioned above may be configured so that the limiting control unit learns the operating speed of the phase changing mechanism when an operational state of the phase changing mechanism is changed from the phase-locked state to the phase-unlocked state in accordance with an engine operation state.

According to the controller configured as mentioned above, the operating speed is learned when the operational state of the phase changing mechanism is changed from the phase-locked state to the phase-unlocked state in accordance with the engine operation state. Therefore, as compared with a case where the phase changing mechanism is operated in order to learn the operating speed, it is possible to reduce the frequency with which the valve timing is changed to a timing not suited for the engine operation state in the course of learning the operating speed.

Also, the controller for a variable valve device mentioned above may be configured so that when learning the operating speed of the phase changing mechanism, the limiting control unit selects a supply and discharge mode for driving the phase changing mechanism at an operating speed higher than or equal to a predetermined operating speed, as a mode of supply and discharge of the hydraulic oil with respect to the phase changing mechanism.

Furthermore, the controller for a variable valve device mentioned above may be configured so that the limiting control unit learns the operating speed of the phase changing mechanism by taking a rotational speed of the internal combustion engine into account.

In the internal combustion engine that supplies hydraulic oil to the phase changing mechanism by the torque of the crankshaft, the operating speed of the phase changing mechanism varies with the rotational speed of the internal combustion engine. Since the controller configured as mentioned above learns the operating speed of the phase changing mechanism by taking the rotational speed of the internal combustion engine into account, it is possible to reduce the influence of this rotational speed on the operating speed to be learned. As a result, it is possible to learn the operating speed of the phase changing mechanism on which the influence of the viscosity of hydraulic oil is reflected more appropriately.

BRIEF DESCRIPTION OF THE DRAWINGS

Features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
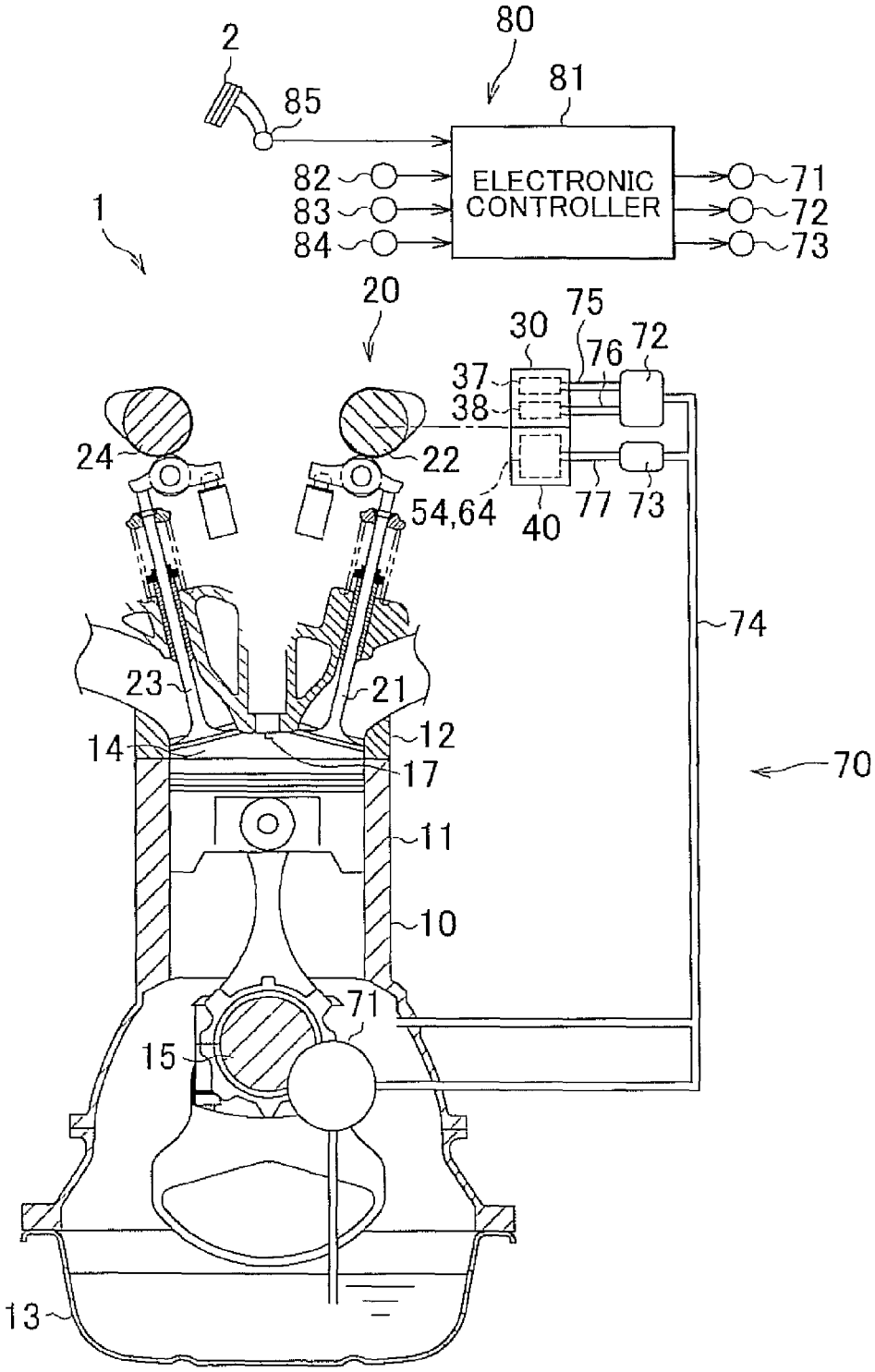
FIG. 1 is a schematic diagram that illustrates the structure of an internal combustion engine including a variable valve device controller according to an embodiment of the invention.

The configuration of an internal combustion engine 1 is described with reference to FIG. 1. The internal combustion engine 1 includes an engine body 10, a variable valve device 20, a hydraulic mechanism 70, and a controller 80. The engine body 10 causes a crankshaft 15 to rotate by combustion of an air/fuel mixture. The variable valve device 20 includes various valve elements. The hydraulic mechanism 70 supplies hydraulic oil to the engine body 10 and the like. The controller 80 controls various devices including the above-mentioned devices in a centralized manner.

The engine body 10 includes a cylinder block 11 where combustion of the air/fuel mixture takes place, a cylinder head 12 provided with the variable valve device 20, and an oil pan 13 that stores the hydraulic oil to be supplied to various sections of the engine body 10.

The variable valve device 20 includes an intake valve 21 that opens and closes the intake port of a combustion chamber 14, an exhaust valve 23 that opens and closes the exhaust port of the combustion chamber 14, an intake camshaft 22 that pushes the intake valve 21 down, and an exhaust camshaft 24 that pushes the exhaust valve 23 down. In addition, the variable valve device 20 includes a valve timing changing mechanism 30 that changes the rotation phase (hereinafter, "valve timing VT") of the intake camshaft 22 with respect to the rotation phase of the crankshaft 15, and a valve timing locking mechanism 40 that locks the valve timing VT.

The valve timing changing mechanism 30 changes the valve timing VT between the valve timing on the most advanced side (hereinafter, "most advanced phase VTmax") and the valve timing on the most retarded side (hereinafter, "most retarded phase VTmin").

The valve timing locking mechanism 40 locks the valve timing VT to a specific valve timing (hereinafter, "intermediate phase VTmdl") between the most retarded phase VTmin and the most advanced phase VTmax. The intermediate phase VTmdl corresponds to a "specific phase".

As the intermediate phase VTmdl, a valve timing VT that allows the internal combustion engine 1 to start in cold climate areas is set. Comparing engine starting performance between a case where the valve timing VT is maintained at the intermediate phase VTmdl at engine startup and a case where the valve timing VT is maintained at a valve timing on the retard side with respect to the intermediate phase VTmdl, the engine starting performance is higher in the former case than in the latter case.

The hydraulic mechanism 70 includes an oil pump 71, an oil control valve 72, and an oil switching valve 73. The oil pump 71 discharges the hydraulic oil in the oil pan 13. The oil control valve 72 controls the mode of supply and discharge of hydraulic oil with respect to the valve timing changing mechanism 30. The oil switching valve 73 controls the mode of supply and discharge of hydraulic oil with respect to the valve timing locking mechanism 40. The hydraulic mechanism 70 also includes a hydraulic passage 74 that supplies the hydraulic oil discharged from the oil pump 71 to various sections of the internal combustion engine 1.

The hydraulic passage 74 includes an advance passage 75, a retard passage 76, and a phase lock passage 77. The advance passage 75 connects an advance chamber 37 in the valve timing mechanism 30, and the oil control valve 72 to each other. The retard passage 76 connects a retard chamber 38 in the valve timing mechanism 30, and the oil control valve 72 to each other. The phase lock passage 77 connects a first unlock chamber 54 and a second unlock chamber 64 in the valve timing locking mechanism 40, and the oil switching valve 73 to each other.

The controller 80 includes an electronic controller 81 that executes various kinds of arithmetic processing to control the internal combustion engine 1, and various sensors such as a crank position sensor 82, a cam position sensor 83, a coolant temperature sensor 84, and an accelerator position sensor 85.

The crank position sensor 82 outputs a signal according to the rotation angle of the crankshaft 15 (hereinafter, "crank angle CA") to the electronic controller 81. The cam position sensor 83 outputs a signal according to the rotation angle of the intake camshaft 22 (hereinafter, "cam angle DA") to the electronic controller 81. The coolant temperature sensor 84 outputs a signal according to the temperature of a coolant (hereinafter, "coolant temperature TW") in the vicinity of the coolant outlet of the cylinder head 12 to the electronic controller 81. The acceleration position sensor 85 outputs a signal according to the amount of depression of an accelerator pedal 2 (hereinafter, "accelerator depression AP") to the electronic controller 81.

Control executed by the electronic controller 81 is described. In the following description, the period of time after a start request for the internal combustion engine 1 is set until the state transitions to idling is referred to as "at engine startup". The period of time after a stop request for the internal combustion engine 1 is set until the rotation of the internal combustion engine 1 stops is referred to as "at engine stop". The period of time during which the rotation of the internal combustion engine 1 is stopped is referred to as "during engine stop". The engine operation state excluding idling during the engine operation between the engine startup and engine stop is referred to as "in normal engine operation".

The electronic controller 81 calculates various parameters as explained below on the basis of outputs from various sensors. (A) The electronic controller 81 calculates a computed value corresponding to crank angle CA, on the basis of an output signal from the crank position sensor 82. (B) The electronic controller 81 calculates a computed value corresponding to the rotational speed of the crankshaft 15 (hereinafter, "engine speed NE"), on the basis of the computed value of the crank angle CA. (C) The electronic controller 81 calculates a computed value corresponding to cam angle DA, on the basis of an output signal from the cam position sensor 83. (D) The electronic controller 81 calculates a computed value corresponding to the valve timing VT, on the basis of the crank angle CA and the cam angle DA. (E) The electronic controller 81 calculates a computed value corresponding to coolant temperature TW, on the basis of an output signal from the coolant temperature sensor 84. (F) The electronic controller 81 calculates a computed value corresponding to accelerator depression AP, on the basis of an output signal from the accelerator position sensor 85.

The electronic controller 81 executes a valve timing control and an operating speed learning control. The valve timing control controls the operations of the valve timing changing mechanism 30 and valve timing locking mechanism 40 on the basis of the engine operation state. The operating speed learning control learns the operating speed of the valve timing changing mechanism 30. As parameters that define engine operation states, engine speed NE, engine load, and the like are used.

The valve timing control includes a phase advance control for advancing the valve timing VT in normal engine operation, a phase retard control for retarding the valve timing VT in normal engine operation, and a phase hold control for holding the valve timing VT by the hydraulic pressure in normal engine operation. Also, the valve timing control includes a phase lock control for locking the valve timing VT by the valve timing locking mechanism 40, and a control at phase unlock that is executed to limit the range over which the valve timing VT can be changed (hereinafter, "variable range").

In the phase advance control and the phase retard control, a target valve timing VT (hereinafter, "target phase VTtrg") is set on the basis of the engine operation state, when a request for advancing the valve timing VT (hereinafter, "phase advance request") or a request for retarding the valve timing VT (hereinafter, "phase retard request") is set by a control that is executed separately.

On the basis of this target phase VTtrg and a computed value of valve timing VT, the oil control valve 72 is controlled to cause the valve timing changing mechanism 30 to execute an advance or retard operation.

The phase hold control controls the oil control valve 72 to cause the valve timing changing mechanism 30 to execute a hold operation, when a request for holding the valve timing VT at a predetermined phase by the hydraulic pressure (hereinafter, "phase hold request") is set by a control that is executed separately.

The phase lock control controls the oil switching valve 73 to cause the valve timing locking mechanism 40 to execute a lock operation, when a request for locking the valve timing VT to the intermediate phase VTmdl (hereinafter, "phase lock request") is set by a control that is executed separately. The phase lock request is set on the basis of the following criteria: engine stop conditions are met; and idling conditions are met. The lock operation refers to the operation of the valve timing locking mechanism 40 to lock the valve timing VT to the intermediate phase VTmdl.

In the control at phase unlock, a phase limitation is executed to limit the variable range. That is, when a phase limitation is being executed, the target phase VTtrg for the valve timing VT is set within the limited variable range. Specifically, when there is a request for changing the valve timing VT to a valve timing VT more advanced than the most advanced valve timing VT within the limited variable range (hereinafter, "advance-side limit phase VTcmax"), the advance-side limit phase VTcmax is set as the target phase VTtrg. Also, when there is a request for changing the valve timing VT to a valve timing VT more retarded than the most retarded valve timing within the limited variable range (hereinafter, "retard-side limit phase VTcmin"), the retard-side limit phase VTcmin is set as the target phase VTtrg.

The operating speed learning control learns the operating speed of the valve timing changing mechanism 30, and limits the variable range on the basis of the learned operating speed. When limiting the variable range, the retard-side limit phase VTcmin and the advance-side limit phase VTcmax are changed in accordance with the operating speed.

The operating speed of the valve timing changing mechanism 30 can be evaluated as a value obtained by dividing the amount of change of valve timing VT by the time required to change the valve timing VT, when the valve timing VT changes from any valve timing VT to another any valve timing VT.

With the state in which the valve timing changing mechanism 30 is locked by the valve timing locking mechanism 40 serving as a reference, when the valve timing VT is changed from this state to another any valve timing VT different from the intermediate phase VTmdl, the following time is used as the time required to change the valve timing VT mentioned above. That is, the time including the time required to change the operational state of the valve timing changing mechanism 30 from a phase-locked state to a phase-unlocked state, and the time until the valve timing VT changes from the intermediate phase VTmdl to the other any valve timing VT mentioned above is the time required to change the valve timing VT.

Figure 2:
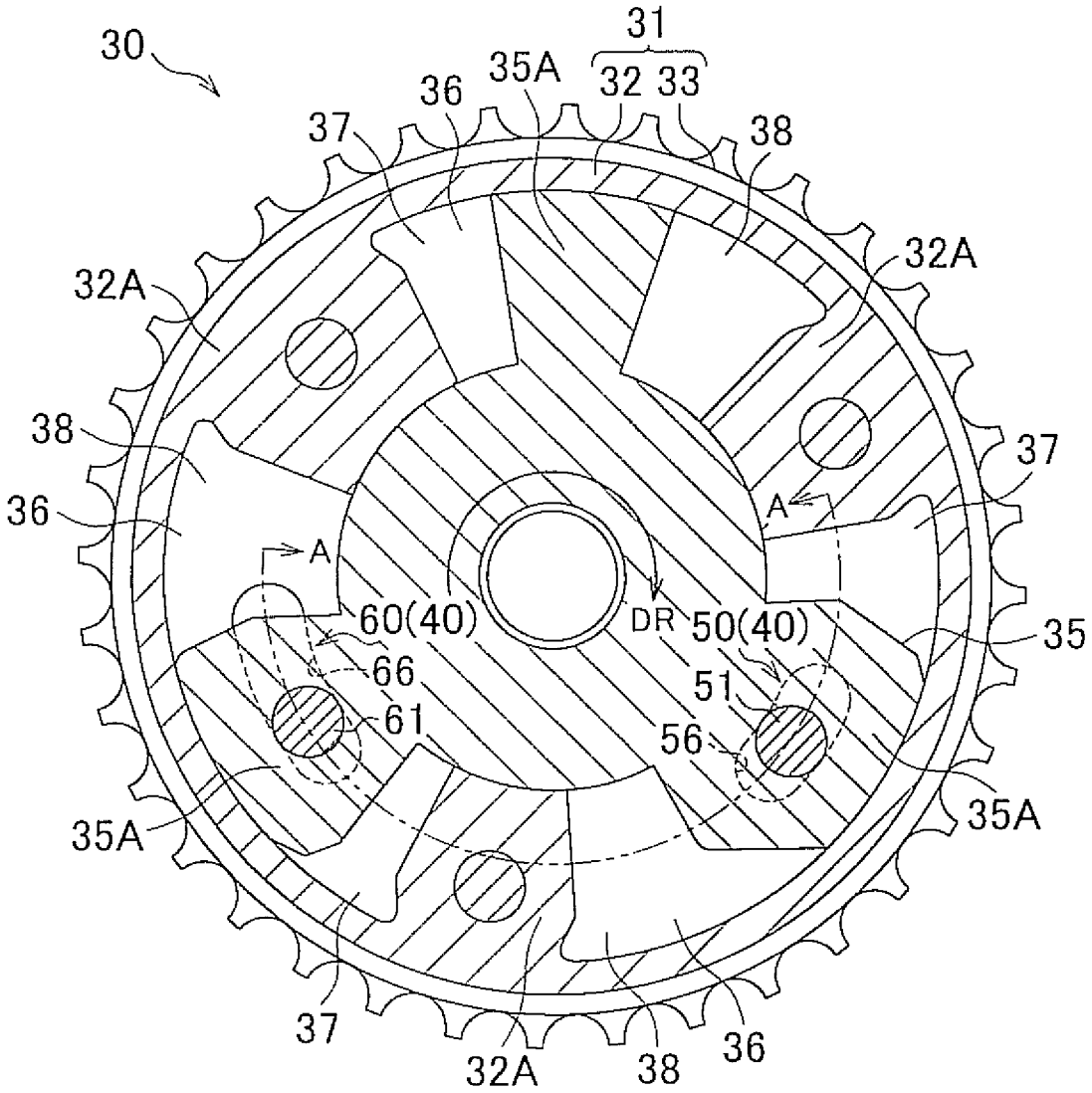
FIG. 2 is a cross-sectional view of a valve timing changing mechanism according to the embodiment taken along the radial direction of the valve timing changing mechanism.

The structure of the valve timing changing mechanism 30 is described with reference to FIG. 2. The valve timing changing mechanism 30 includes a housing rotor 31 that rotates in synchronization with the crankshaft 15, and a vane rotor 35 that rotates in synchronization with the intake camshaft 22.

The valve timing VT is changed in accordance with the rotation phase of the vane rotor 35 with respect to the housing rotor 31. The arrow DR in FIG. 2 indicates the rotational direction of a sprocket 33 (crankshaft 15) and the intake camshaft 22.

Figure 3:
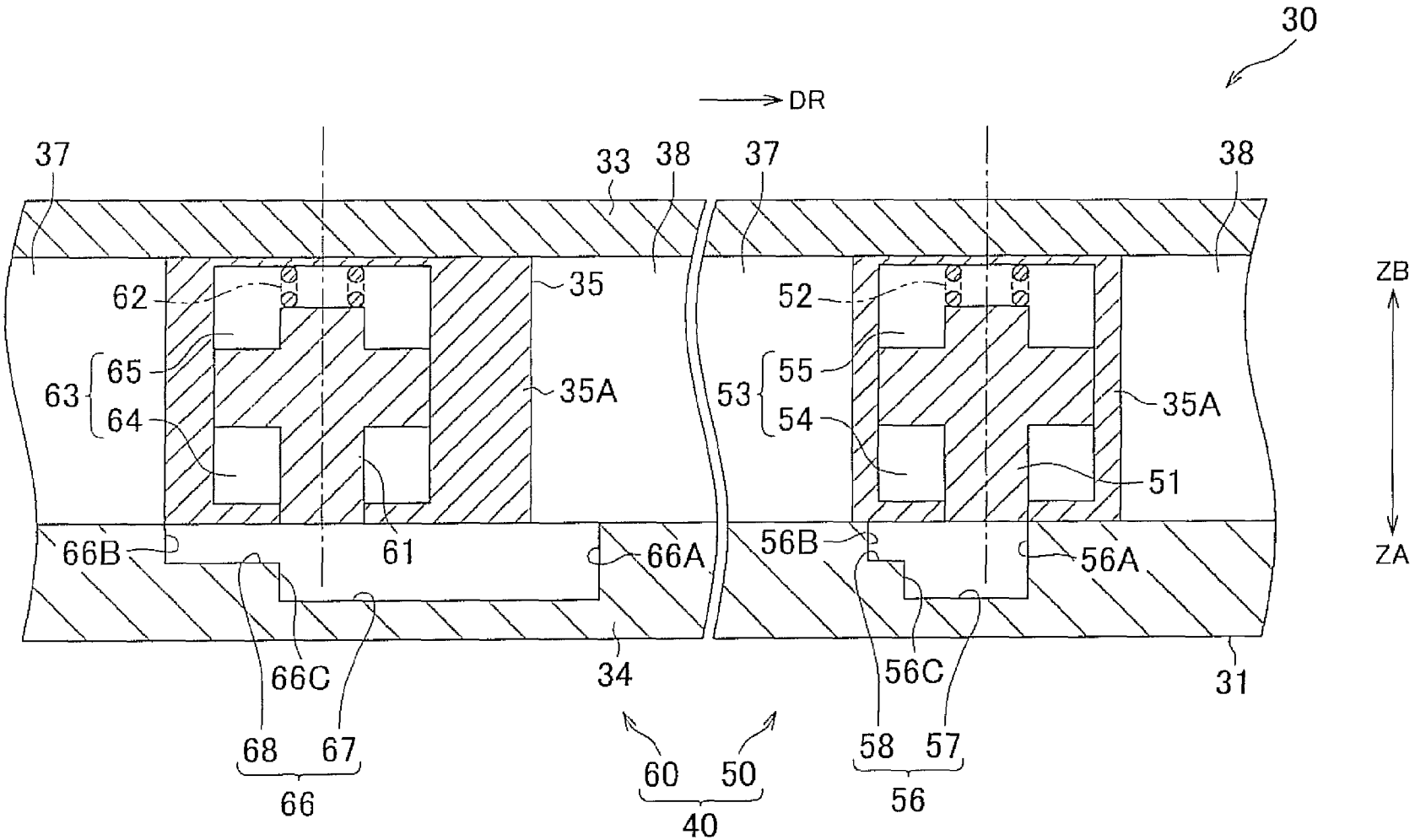
FIG. 3 is a cross-sectional view of the valve timing changing mechanism according to the embodiment taken along the line A-A in FIG. 2 and expanded into a plane, which illustrates a case when a first lock pin and a second lock pin are in their retracted position.

The housing rotor 31 includes a housing body 32, the sprocket 33, and a cover 34 (see FIG. 3). The housing body 32 serves as the body of the housing rotor 31. The sprocket 33 is attached to one axial end of the housing body 32. The cover 34 is attached to the other axial end of the housing body 32.

The housing body 32 has three partition walls 32A that project radially with respect to the rotary shaft of the housing rotor 31. The housing body 32, the sprocket 33, and the cover 34 are fastened to each other with three bolts inserted in the axial direction of these components.

The vane rotor 35 is arranged in the space inside the housing body 32. The vane rotor 35 is fastened to an end of the intake camshaft 22. The vane rotor 35 has three vanes 35A that project toward the housing body 32.

Three accommodating chambers 36 are defined inside the valve timing changing mechanism 30. Each of the accommodating chambers 36 defined is surrounded by the wall portion on the outer periphery of the housing body 32, adjacent partition walls 32A, the wall portion around the rotary shaft of the vane rotor 35, the sprocket 33, and the cover 34. One vane 35A is arranged in each one accommodating chamber 36. Each accommodating chamber 36 is partitioned by a corresponding one of the vanes 35A into an advance chamber 37 and a retard chamber 38.

The advance chamber 37 is defined on the rearward side in the rotational direction DR of the intake camshaft with respect to the vane 35A inside the accommodating chamber 36. The retard chamber 38 is defined on the forward side in the rotational direction DR of the intake camshaft 22 with respect to the vane 35A inside the accommodating chamber 36. The volumes of the advance chamber 37 and retard chamber 38 vary in accordance with the mode of supply and discharge of hydraulic oil with respect to valve timing changing mechanism 30.

The valve timing locking mechanism 40 includes a first locking mechanism 50 and a second locking mechanism 60. The first locking mechanism 50 restricts the rotational range of the vane rotor 35 with respect to the housing rotor 31. The second locking mechanism 60 restricts the rotational range of the vane rotor 35 with respect to the housing rotor 31 to a range different from that of the first locking mechanism 50. Different vanes 35A are arranged in the first locking mechanism 50 and the second locking mechanism 60. When the rotation phase of the vane rotor 35 with respect to the housing rotor 31 is a rotation phase corresponding to the intermediate phase VTmdl (hereinafter, "intermediate rotation phase"), the valve timing VT is locked to the intermediate phase VTmdl through cooperation between the first locking mechanism 50 and the second locking mechanism 60.

The operation of the valve timing changing mechanism 30 is described. When the vane rotor 35 rotates to the advance side, that is, in the rotational direction DR with respect to the housing rotor 31 upon supply of hydraulic oil to the advance chamber 37 and discharge of hydraulic oil from the retard chamber 38, the valve timing VT advances. When the vane rotor 35 rotates to the most advanced side with respect to the housing rotor 31, that is, when the rotation phase of the vane rotor 35 with respect to the housing rotor 31 is located on the most forward side in the rotational direction DR, the valve timing VT is set to the most advanced phase VTmax.

When the vane rotor 35 rotates to the retard side, that is, in a direction opposite to the rotational direction DR with respect to the housing rotor 31 upon discharge of hydraulic oil from the advance chamber 37 and supply of hydraulic oil to the regard chamber 38, the valve timing VT retards. When the vane rotor 35 rotates to the most retarded side with respect to the housing rotor 31, that is, when the rotation phase of the vane rotor 35 with respect to the housing rotor 31 is located on the most rearward side in the rotational direction DR, the valve timing VT is set to the most retarded phase VTmin.

Figure 4:
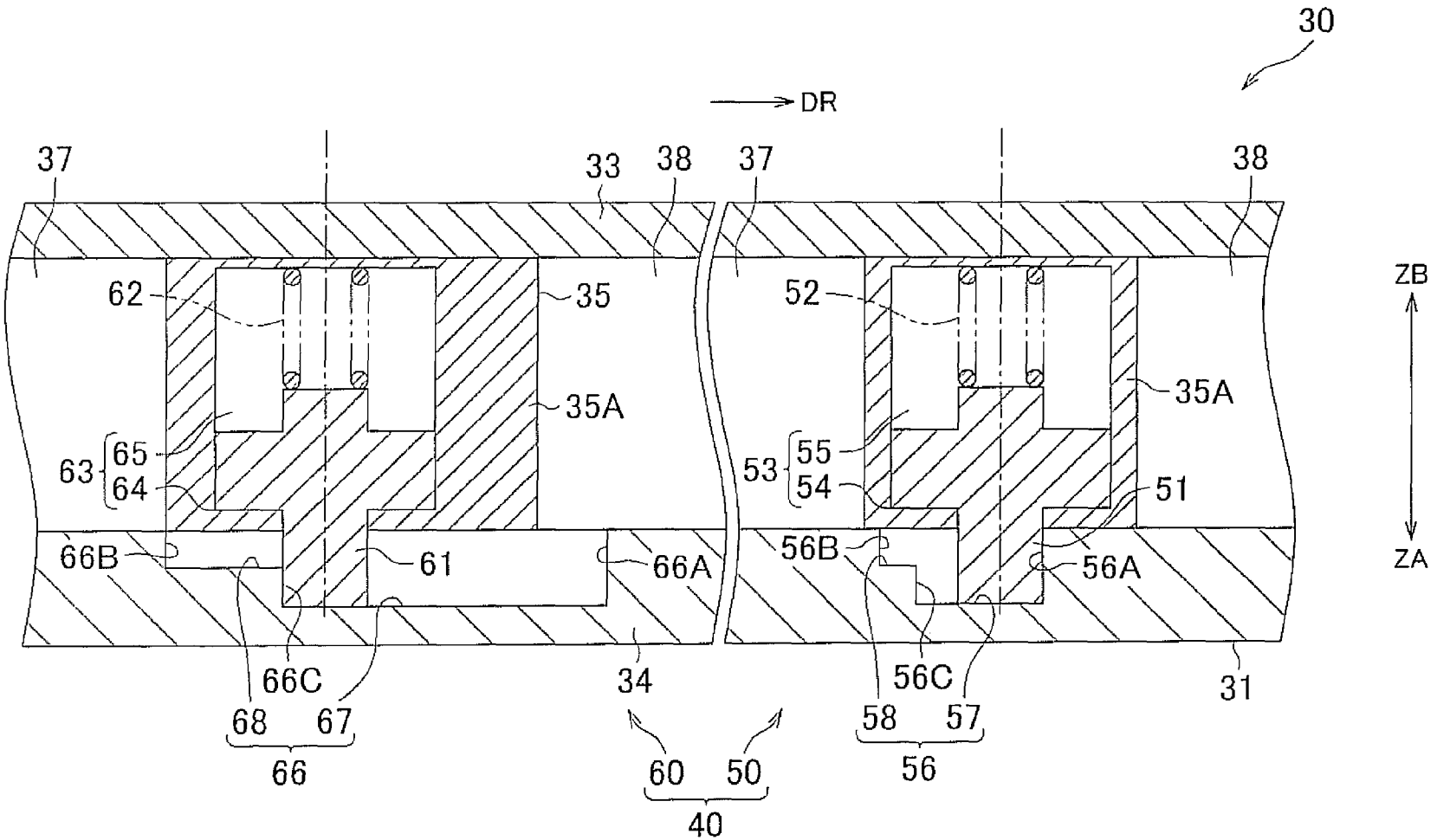
FIG. 4 is a cross-sectional view of the valve timing changing mechanism according to the embodiment taken along the line A-A in FIG. 2 and expanded into a plane, which illustrates a case when the first lock pin and the second lock pin are in their projected position.

The configurations of the first locking mechanism 50 and second locking mechanism 60 are described with reference to FIGS. 3 and 4. FIGS. 3 and 4 each illustrate a cross-section of the valve timing changing mechanism 30 taken along the line A-A in FIG. 2 and expanded into a plane. Also, FIGS. 3 and 4 each illustrate a state in which the rotation phase of the vane rotor 35 is the intermediate rotation phase with respect to the housing rotor 31. In the following description, the direction in which a first lock pin 51 of the first locking mechanism 50 and a second lock pin 61 of the second locking mechanism 60 project from the vane 35A is referred to as "projecting direction ZA", and the direction in which the first lock pin 51 and the second lock pin 61 are retracted into the vane 35A is referred to as "retracting direction ZB".

The configuration of the first locking mechanism 50 is described below. The first locking mechanism 50 includes the first lock pin 51 and a first lock spring 52. The first lock pin 51 moves in the axial direction of the vane rotor 35 with respect to the vane 35A. The first lock spring 52 is used to push the first lock pin 51 in the projecting direction ZA. In addition to these components, the first locking mechanism 50 includes a first lock chamber 53 and a first engaging groove 56. The first lock chamber 53 accommodates the first lock pin 51 and the first lock spring 52. The first engaging groove 56 is defined in correspondence to the circumferential path of the first lock pin 51.

The first lock chamber 53 is defined inside the vane 35A. Also, the first lock chamber 53 is partitioned by the first lock pin 51 into a first unlock chamber 54 and a first spring chamber 55. Provided that there is no flow of hydraulic oil via the clearance between the components constituting the first locking mechanism 50, no flow of hydraulic oil occurs between the first unlock chamber 54 and the first spring chamber 55.

The first engaging groove 56 includes two grooves with different depths, that is, a first lower groove 57 with a relatively large depth, and a first upper groove 58 with a relatively small depth. The first upper groove 58 is provided on the retard side with respect to the first lower groove 57.

A first advance end 56A as the advance-side end of the first lower groove 57 is provided at a position corresponding to an end face on the advance side with respect to the first lock pin 51 of the vane rotor 35 which is in the intermediate rotation phase. A first retard end 56B as the retard-side end of the first upper groove 58 is defined on the retard side with respect to the first advance end 56A. A second retard end 56C as the retard-side end of the first lower groove 57 is defined between the first advance end 56A and the first retard end 56B.

The configuration of the second locking mechanism 60 is described below. The second locking mechanism 60 includes the second lock pin 61 and a second lock spring 62. The second lock pin 61 moves in the axial direction of the vane rotor 35 with respect to the vane 35A. The second lock spring 62 is used to push the second lock pin 61 in the projecting direction ZA. In addition to these components, the second locking mechanism 60 includes a second lock chamber 63 and a second engaging groove 66. The second lock chamber 63 accommodates the second lock pin 61 and the second lock spring 62. The second engaging groove 66 is defined in correspondence to the circumferential path of the second lock pin 61.

The second lock chamber 63 is defined inside the vane 35A. Also, the second lock chamber 63 is partitioned by the second lock pin 61 into a second unlock chamber 64 and a second spring chamber 65. Provided that there is no flow of hydraulic oil via the clearance between the components constituting the second locking mechanism 60, no flow of hydraulic oil occurs between the second unlock chamber 64 and the second spring chamber 65.

The second engaging groove 66 includes two grooves with different depths, that is, a second lower groove 67 with a relatively large depth, and a second upper groove 68 with a relatively small depth. The second upper groove 68 is provided on the retard side with respect to the second lower groove 67.

A fourth retard end 66C as the retard-side end of the second lower groove 67 is provided at a position corresponding to an end face on the retard side with respect to the second lock pin 61 of the vane rotor 35 which is in the intermediate rotation phase. A third retard end 66B as the retard-side end of the second upper groove 68 is defined on the retard side with respect to the fourth retard end 66C. A second advance end 66A as the advance-side end of the second lower groove 67 is defined on the advance side with respect to the fourth retard end 66C.

The operation of the valve timing locking mechanism 40 is described with reference to FIGS. 3 and 4. The first lock pin 51 and the second lock pin 61 each axially move within the range from the retracted position illustrated in FIG. 3 to the projected position illustrated in FIG. 4, in accordance with the relationship between the force that acts on the first lock pin 51 or the second lock pin 61 on the basis of the hydraulic pressure in the first unlock chamber 54 or the second unlock chamber 64, and the spring force of the first lock spring 52 or the second lock spring 62.

The projected position of the first lock pin 51 represents the position when the tip of the first lock pin 51 is in contact with the bottom of the first lower groove 57 of the first engaging groove 56. Also, the projected position of the second lock pin 61 represents the position when the tip of the second lock pin 61 is in contact with the bottom of the second lower groove 67 of the second engaging groove 66. The retracted position of the first lock pin 51 represents the position when the tip of the first lock pin 51 is retracted into the vane 35A. Also, the retracted position of the second lock pin 61 represents the position when the tip of the second lock pin 61 is retracted into the vane 35A.

The specific mode of operation of the first lock pin 51 with respect to the vane 35A is described in (A) and (B) below. Since the second lock pin 61 also operates in a manner similar to the first lock pin 51, a description of the operation of the second lock pin 61 is omitted here.

(A) When the force acting on the first lock pin 51 on the basis of the hydraulic pressure in the first unlock chamber 54 is smaller than the spring force of the first lock spring 52, a force that causes the first lock pin 51 to move in the projecting direction ZA (hereinafter, "projecting force") is continuously applied to the first lock pin 51. When the first lock pin 51 is in a position corresponding to the first lower groove 57 of the first engaging groove 56, the position of the first lock pin 51 with respect to the vane 35A is the retracted position, and a projecting force is acting on the first lock pin 51, the position of the first lock pin 51 changes from the retracted position to the projected position.

(B) When the force acting on the first lock pin 51 on the basis of the hydraulic pressure in the first unlock chamber 54 is larger than the spring force of the first lock spring 52, a force that causes the first lock pin 51 to move in the retracting direction ZB (hereinafter, "retracting force") is continuously applied to the first lock pin 51. When the position of the first lock pin 51 with respect to the vane 35A is the projected position, and a retracting force is acting on the first lock pin 51, the position of the first lock pin 51 changes from the projected position to the retracted position.

The valve timing locking mechanism 40 locks the valve timing VT as explained below. When the first lock pin 51 is in the projected position, the valve timing locking mechanism 40 restricts the vane rotor 35 from rotating to the side more advanced than the intermediate rotation phase with respect to the housing rotor 31. When the second lock pin 61 is in the projected position, the valve timing locking mechanism 40 restricts the vane rotor 35 from rotating to the side more retarded than the intermediate rotation phase with respect to the housing rotor 31.

Therefore, when the first lock pin 51 and the second lock pin 61 are in the projected position, the vane rotor 35 is unable to rotate in neither the advance direction nor the retard direction from the intermediate rotation phase with respect to the housing rotor 31. That is, because the first lock pin 51 and the second lock pin 61, and the housing rotor 31 are in contact with each other, the valve timing VT is locked to the intermediate phase VTmdl.

In this regard, with respect to the operational state of the valve timing changing mechanism 30 and the operational state of the valve timing locking mechanism 40, "phase-unlocked state" and "phase-locked state" are defined as explained below.

The operational state of the valve timing locking mechanism 40 when the first lock pin 51 and the second lock pin 61 are in the retracted position is defined as "phase-unlocked state of the valve timing locking mechanism 40". Also, the operational state of the valve timing changing mechanism 30 in which the valve timing VT can be changed as a result of the operational state of the valve timing locking mechanism 40 being set in the phase-unlocked state is defined as "phase-unlocked state of the valve timing changing mechanism 30". FIG. 3 illustrates an example of when the valve timing changing mechanism 30 and valve timing locking mechanism 40 are in their phase-unlocked state.

The operational state of the valve timing locking mechanism 40 when the first lock pin 51 and the second lock pin 61 are in the projected position is defined as "phase-locked state of the valve timing locking mechanism 40". Also, the operational state of the valve timing changing mechanism 30 in which the valve timing VT is locked to the intermediate phase VTmdl as a result of the operational state of the valve timing locking mechanism 40 being set in the phase-locked state is defined as "phase-locked state of the valve timing changing mechanism 30". FIG. 4 illustrates an example of when the valve timing changing mechanism 30 and valve timing locking mechanism 40 are in their phase-locked state.

Control of the oil control valve 72 is described. The electronic controller 81 changes the operational state of the oil control valve 72 (hereinafter, "OCV operation mode" by changing the duty ratio as a command signal for the actuator of the oil control valve 72.

Specifically, the range of values that the duty ratio can take is classified into three regions in accordance with the value of duty ratio, and each of these classified areas is associated with a corresponding OCV operation mode in advance. Then, upon selecting the OCV operation mode to be applied to the oil control valve 72, a duty ratio corresponding to the selected OCV operation mode is outputted to the actuator of the oil control valve 72. Also, by changing duty ratio within a duty ratio range corresponding to each OCV operation mode, supply speed and discharge speed are changed as the mode of supply and discharge of hydraulic oil.

The relationship between each OCV operation mode and operation of the valve timing changing mechanism 30 is described below. (A) When the OCV operation mode is set to an advance mode, hydraulic oil is supplied to the advance chamber 37, and hydraulic oil is discharged from the retard chamber 38. As a result, the vane rotor 35 rotates in the advance direction with respect to the housing rotor 31. Also, by changing the duty ratio within a duty ratio range associated with the advance mode, the speed at which the vane rotor 35 rotates in the advance direction with respect to the housing rotor 31 (hereinafter, "advance direction") can be changed.

(B) When the OCV operation mode is set to a hold mode, the advance chamber 37 and the retard chamber 38 are closed. As a result, the rotational position of the vane rotor 35 with respect to the housing rotor 31 is held.

(C) When the OCV operation mode is set to a retard mode, hydraulic oil is discharged from the advance chamber 37, and hydraulic oil is supplied to the retard chamber 38. As a result, the vane rotor 35 rotates in the retard direction with respect to the housing rotor 31. Also, by changing the duty ratio within a duty ratio range associated with the retard mode, the speed at which the vane rotor 35 rotates in the retard direction with respect to the housing rotor 31 (hereinafter, "retard speed") can be changed.

Control of the oil switching valve 73 is described. The electronic controller 81 changes the operational state of the oil switching valve 73 (hereinafter, "OSV operation mode") by changing a command signal for the actuator of the oil switching valve 73.

The relationship between each OSV operation mode and operation of the valve timing locking mechanism 40 is described below. (A) When the OSV operation mode is set to a lock mode, hydraulic oil is discharged from the first unlock chamber 54 and the second unlock chamber 64. As a result, a projecting force acts on the first lock pin 51 and the second lock pin 61.

(B) When the OSV operation mode is set to an unlock mode, hydraulic oil is supplied to the first unlock chamber 54 and the second unlock chamber 64. As a result, a retracting force acts on the first lock pin 51 and the second lock pin 61.

In the valve timing control, the electronic controller 81 controls the oil control valve 72 and the oil switching valve 73 in accordance with the engine operation state in the manner as explained in (A) to (D) below.

(A) In normal engine operation, one of the advance mode, the hold mode, and the retard mode is selected as the OCV operation mode in accordance with the engine operation state. Also, the OSV operation mode is set to the unlock mode.

(B) When a phase lock request is set in normal engine operation, the OSV operation mode is changed from the unlock mode to the lock mode. Also, an OCV operation mode for changing the valve timing VT to the intermediate phase VTmdl is selected. Examples of situations where a phase lock request is set in normal engine operation include when engine stop conditions are met in normal engine operation, and when idling conditions are met in normal engine operation.

(C) At engine startup, when the operational state of the valve timing changing mechanism 30 is the phase-locked state, and unlock conditions at startup are not met, changes to the operational state of the valve timing changing mechanism 30 based on a phase advance request, a phase retard request, or a phase hold request are disabled. This control is executed in precedence to the control (D) below.

(D) At engine startup or idling, when the operational state of the valve timing changing mechanism 30 is the phase-locked state, the unlock conditions at startup are met, and a phase advance request or a phase retard request is set, the OSV operation mode is changed from the locked mode to the unlocked mode. Also, the OCV operation mode is changed from the hold mode to the advance mode or the retard mode.

The unlock conditions at startup are set as conditions to ascertain that there is less fear that the valve timing VT may become unstable even if the operational state of the valve timing changing mechanism 30 is changed to the phase-unlocked state at engine startup. The valve timing VT is regarded as being unstable when the advance chamber 37 and the retard chamber 38 are not filled with hydraulic oil and hence there are large fluctuations in valve timing VT.

In the control (D) mentioned above, when the operational state of the valve timing changing mechanism 30 is set to the phase-unlocked state on the basis of the fact that the unlock conditions at startup are met at engine startup, the control at phase unlock is executed using a variable range set by the operating speed learning control.

The purpose of the control at phase unlock is described. When the operational state of the valve timing changing mechanism 30 is changed from the phase-locked state to the phase-unlocked state after engine startup, and when an engine stall has occurred, a phase lock request is set. As a result, the valve timing VT is changed to the intermediate phase VTmdl while the engine speed NE decreases.

At this time, combustion of the internal combustion engine 1 is stopped, and thus the hydraulic pressure in the valve timing changing mechanism 30 gradually decreases. When the hydraulic pressure in the valve timing changing mechanism 30 drops below a predetermined hydraulic pressure, it is no longer possible to control the valve timing VT by the hydraulic pressure. For this reason, in order to set the operational state of the valve timing changing mechanism 30 to the phase-locked state when an engine stall occurs, it is preferable to change the valve timing VT to the intermediate phase VTmdl before the elapsed time since the engine stall (hereinafter, "post-stall period") exceeds a control feasible period. The control feasible period represents the period of time until the hydraulic pressure in the valve timing changing mechanism 30 drops below a predetermined hydraulic pressure after an engine stall occurs. The length of this control feasible period varies every time an engine stall occurs.

The greater the difference between the valve timing VT and the intermediate phase VTmdl at the time when an engine stall occurs, the greater the amount of change of the valve timing VT needed for the valve timing VT to reach the intermediate phase VTmdl in the control feasible period. Therefore, there is a higher possibility that the valve timing VT does not reach the intermediate phase VTmdl within the control feasible period.

Accordingly, in the control at phase unlock, when the operational state of the valve timing changing mechanism 30 is changed from the phase-locked state to the phase-unlocked state after completion of engine startup, a phase limitation is executed in accordance with coolant temperature TW.

When a phase limitation is being executed, in a case where the valve timing VT is on the advance side with respect to the intermediate phase VTmdl, the maximum difference between the intermediate phase VTmdl and the valve timing VT is the difference between the advance-side limit phase VTcmax and the intermediate phase VTmdl. This difference in valve timing VT is smaller than the difference between the most advanced phase VTmax and the intermediate phase VTmdl.

In a case where the valve timing VT is on the retard side with respect to the intermediate phase VTmdl, the maximum difference between the intermediate phase VTmdl and the valve timing VT is the difference between the retard-side limit phase VTcmin and the intermediate phase VTmdl. This difference in valve timing VT is smaller than the difference between the most retarded phase VTmin and the intermediate phase VTmdl.

For this reason, when an engine stall occurs while the phase limitation is executed, as compared with when an engine stall occurs while the phase limitation is not executed, the maximum amount of change of the valve timing VT needed for the valve timing VT to reach the intermediate phase VTmdl is small. That is, executing the phase limitation increases the possibility of the valve timing VT reaching the intermediate phase VTmdl within the control feasible period.

Figure 5:
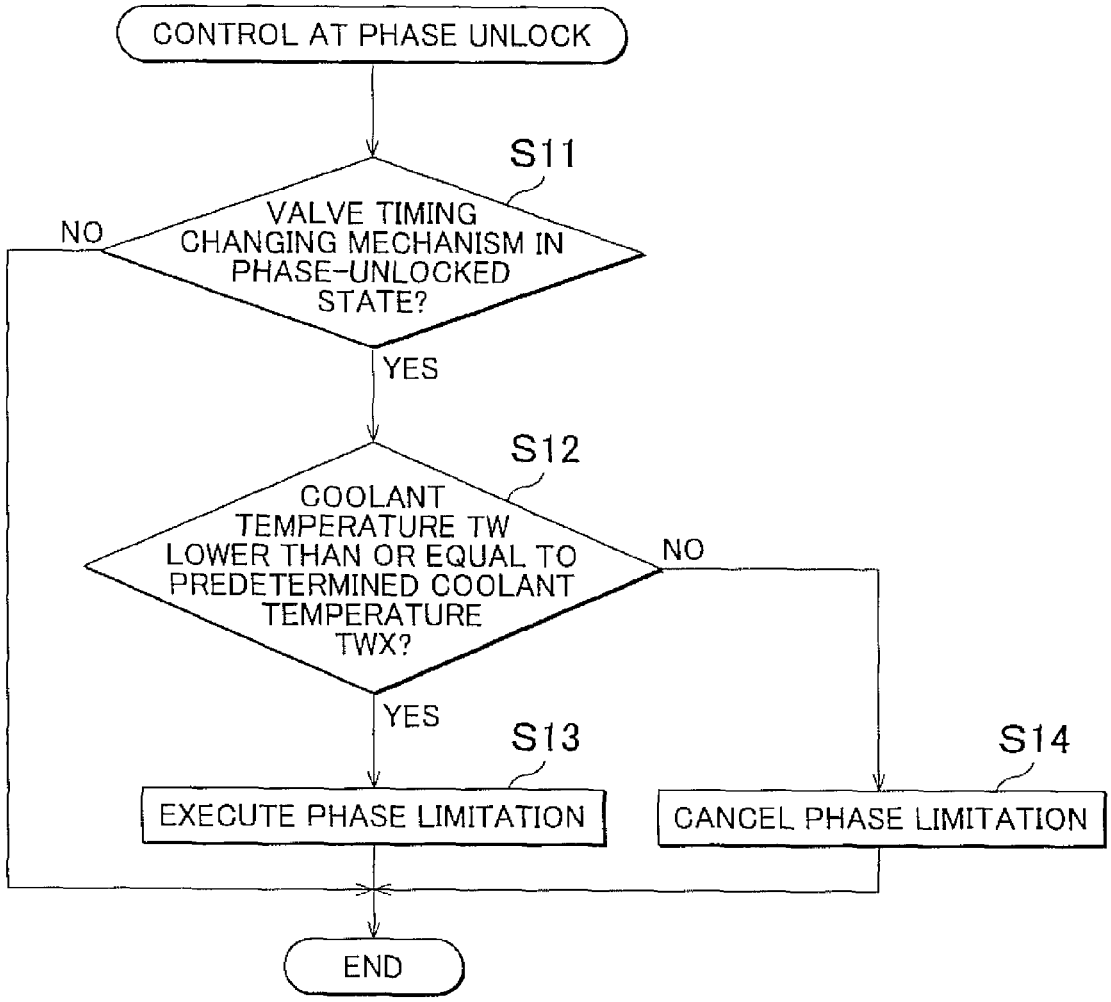
FIG. 5 is a flow chart that illustrates the procedure of a "control at phase unlock" executed by an electronic controller according to the embodiment.

A specific procedure of the control at phase unlock is described with reference to FIG. 5. This control is executed by the electronic controller 81 every predetermined control period. That is, after the last step ends, execution of the same control is put on hold until a predetermined control period elapses, and upon elapse of the predetermined control period, the control at phase unlock is executed again from the first step.

In step S11, it is determined whether or not the operational state of the valve timing changing mechanism 30 is the phase-unlocked state. When it is determined in step S11 that the operational state of the valve timing changing mechanism 30 is the phase-unlocked state, the processing transitions to step S12. When it is determined in step S11 that the operational state of the valve timing changing mechanism 30 is not the phase-unlocked state, that is, when it is determined in step S11 that the operational state of the valve timing changing mechanism 30 is the phase-locked state, the processing is ended once.

In step S12, it is determined whether or not the coolant temperature TW is lower than or equal to a predetermined coolant temperature TW (hereinafter, "predetermined coolant temperature TWX"). The predetermined coolant temperature TWX is set to a temperature that makes the operating speed of the valve timing changing mechanism 30 higher than or equal to a predetermined speed, irrespective of the composition of hydraulic oil. The predetermined speed corresponds to the lowest operating speed of the valve timing changing mechanism 30 required in normal engine operation.

When it is determined in step S12 that the coolant temperature TW is lower than or equal to the predetermined coolant temperature TWX, a phase limitation that limits the variable range is executed in step S13. When it is determined in step S12 that the coolant temperature TW is higher than the predetermined coolant temperature TWX, a phase limitation is canceled in step S14.

Figure 6:
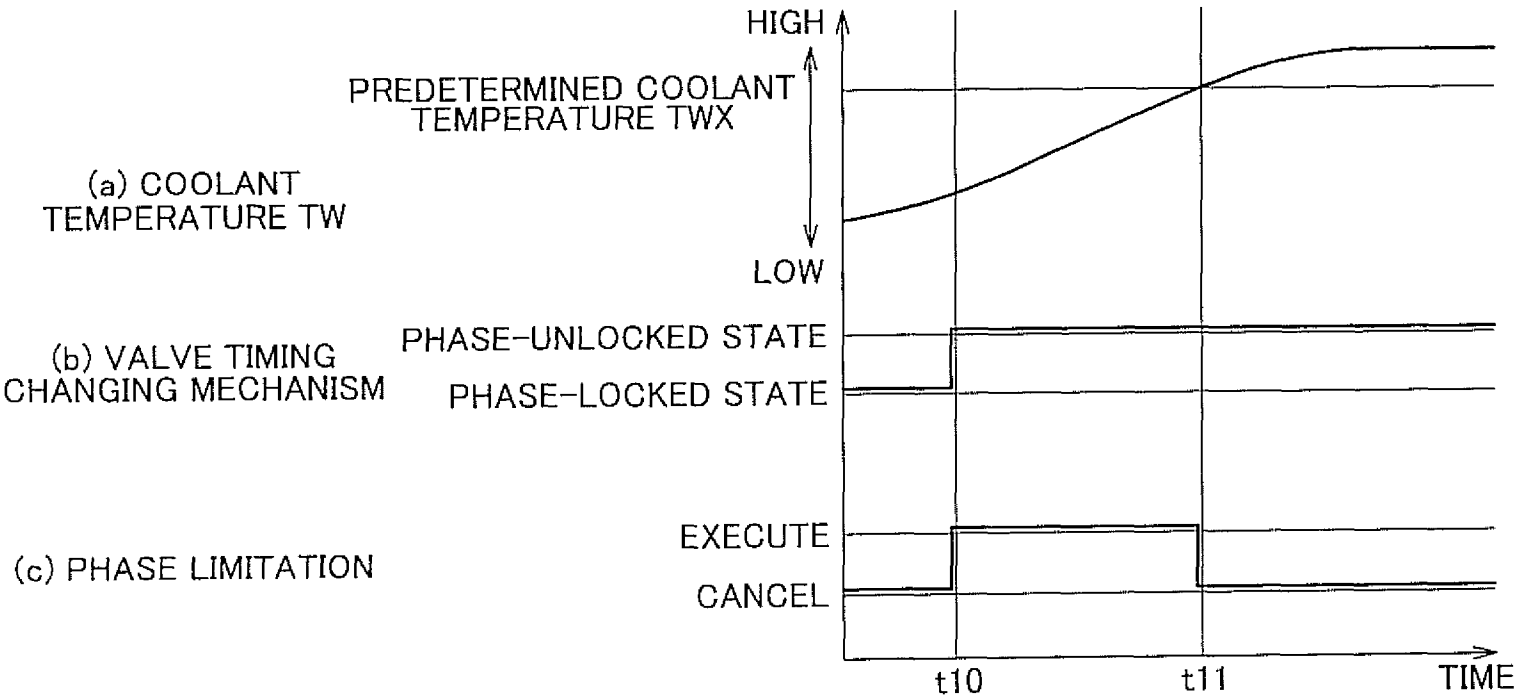
FIG. 6 is a timing chart that illustrates an example of the mode of execution of the "control at phase unlock" executed by the electronic controller according to the embodiment.

An example of the mode of execution of the control at phase unlock is described with reference to FIG. 6. At time t10, that is, when the unlock conditions at startup are met, the operational state of the valve timing changing mechanism 30 is changed from the phase-locked state to the phase-unlocked state. Also, a phase limitation is executed on the basis of the fact that the coolant temperature TW is lower than or equal to the predetermined coolant temperature TWX.

At time t11, that is, when the coolant temperature TW exceeds the predetermined coolant temperature TWX, the phase limitation is canceled. Thereafter, the valve timing VT is changed between the most advanced phase VTmax and the most retarded phase VTmin on the basis of the engine operation state.

Different kinds of hydraulic oils differ in their composition. Also, the composition of hydraulic oil changes with degradation of the hydraulic oil. Hydraulic oils with different compositions differ in their hydraulic oil viscosity (hereinafter, "oil viscosity") even at the same oil temperature.

Assuming that the oil temperature and the engine speed NE are the same between the two kinds of hydraulic oils, a comparison between the operating speed of the valve timing changing mechanism 30 when the hydraulic oil with a relatively high oil viscosity is used (hereinafter, "during high viscosity oil use"), and the operating speed of the valve timing changing mechanism 30 when the hydraulic oil with a relatively low oil viscosity is used (hereinafter, "during low viscosity oil use") reveals that the operating speed in the former case is lower than the operating speed in the latter case owing to the greater resistance acting on the hydraulic oil with the higher viscosity. That is, the operating speed of the valve timing changing mechanism 30 varies under the influence of not only oil temperature but also oil viscosity based on the difference in the composition of hydraulic oil.

Since the operating speed of the valve timing changing mechanism 30 is smaller during high viscosity oil use than during low viscosity oil use, when an engine stall occurs during high viscosity oil use, there is a high possibility that the valve timing VT does not reach the intermediate phase VTmdl within the control feasible period.

Since the operating speed of the valve timing changing mechanism 30 is higher during low viscosity oil use than during high viscosity oil use, when an engine stall occurs during low viscosity oil use, the possibility of the valve timing VT not reaching the intermediate phase VTmdl within the control feasible period is low. For this reason, it is allowed to make the size of the variable range during low viscosity oil use larger than the size of the variable range during high viscosity oil use. Accordingly, in the operating speed learning control, the size of the variable range used in the phase limitation is varied with the operating speed of the valve timing changing mechanism 30.

Figure 7:
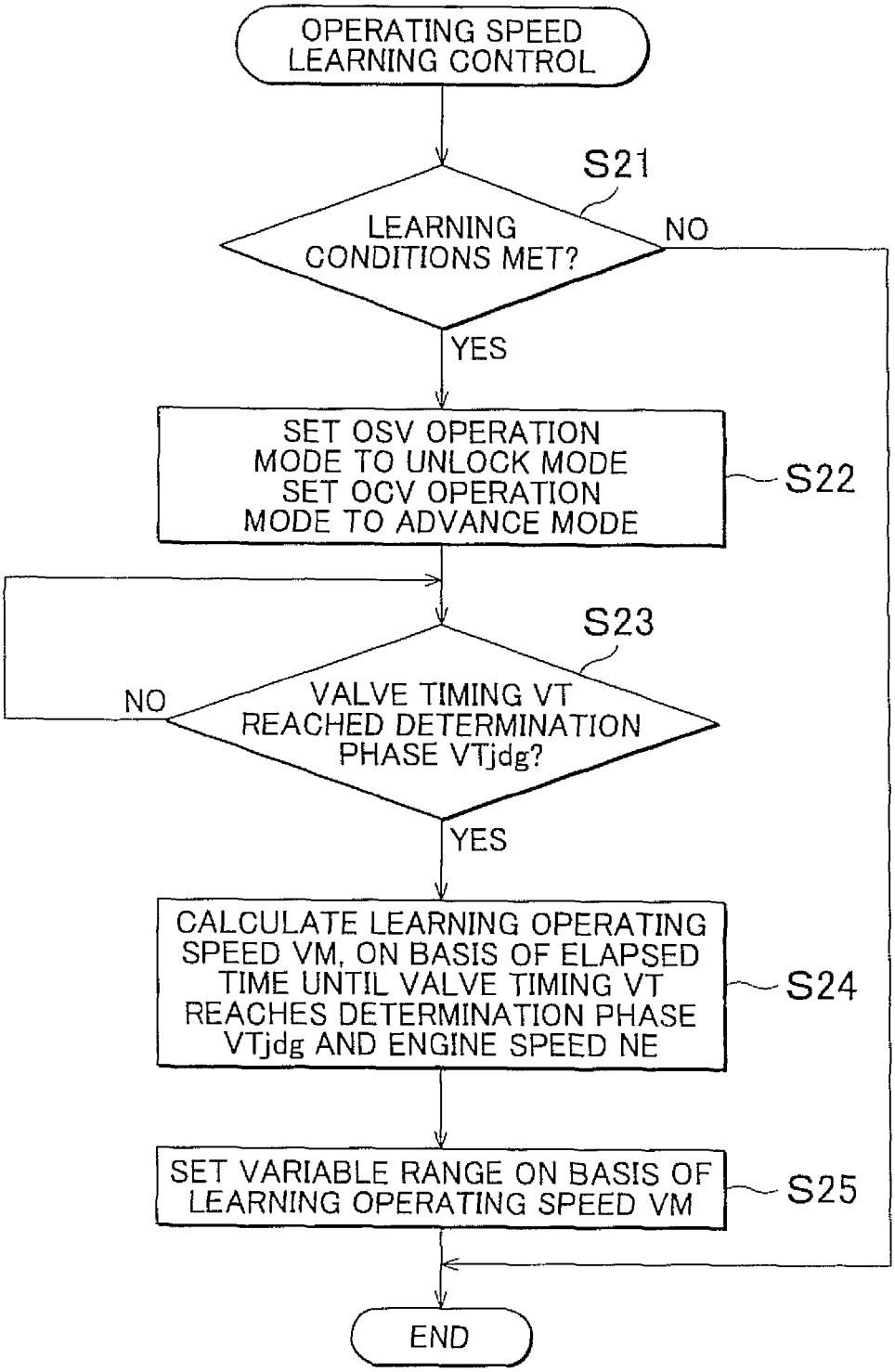
FIG. 7 is a flow chart that illustrates the procedure of an "operating speed learning control" executed by the electronic controller according to the embodiment.

A specific procedure of the operating speed learning control is described with reference to FIG. 7. This control is executed by the electronic controller 81 every predetermined control period. That is, after the last step ends, execution of the same control is put on hold until a predetermined control period elapses, and upon elapse of the predetermined control period, the operating speed learning control is executed again from the first step.

In step S21, it is determined whether or not learning conditions are met. At this time, the learning conditions are determined to be met when all of the conditions (A) to (E) explained below are met. When it is determined in step S21 that the learning conditions are met, the processing transfers to step S22. When it is determined in step S21 that the learning conditions are not met, the processing is ended once. (A) The valve timing locking mechanism 40 is in the phase-locked state. (B) The coolant temperature TW is higher than or equal to a temperature indicative of completion of warm-up. (C) The current state is idling. (D) The unlock conditions at startup are met, and a phase advance request has been set. (E) The operating speed learning control has not been executed after the engine is started this time.

In step S22, the advance mode is selected as the OCV operation mode, the maximum advance speed is selected as the advance speed, and the OSV operation mode is set to the unlock mode. In step S23, it is determined whether or not the valve timing VT has reached a predetermined valve timing VT (hereinafter, "determination phase VTjdg"). When it is determined that the valve timing VT has reached the determination phase VTjdg, the processing transfers to step S24. The determination process in step S23 is repeated until the valve timing VT reaches the determination phase VTjdg.

In step S24, the operating speed of the valve timing changing mechanism 30 which is obtained by learning (hereinafter, "learning operating speed VM") is calculated on the basis of the period of time that has elapsed until the valve timing VT reaches the determination phase VTjdg since execution of the processing in step S22, and the engine speed NE at the time of execution of the processing in step S22. Provided that the elapsed time until the valve timing VT reaches the determination phase VTjdg is the same, the learning operating speed VM becomes lower as the engine speed NE becomes higher. The above-mentioned elapsed time includes the period of time until the operational state of the valve timing changing mechanism 30 is changed from the phase-locked state to the phase-unlocked state, and the period of time until the valve timing VT changes from the intermediate phase VTmdl to the determination phase VTjdg.

In step S25, by applying the learning operating speed VM that has been calculated in step S24 to a variable range map (see FIG. 8), the variable range corresponding to the learning operating speed VM is set as the variable range to be used in the phase limitation.

Figure 8:
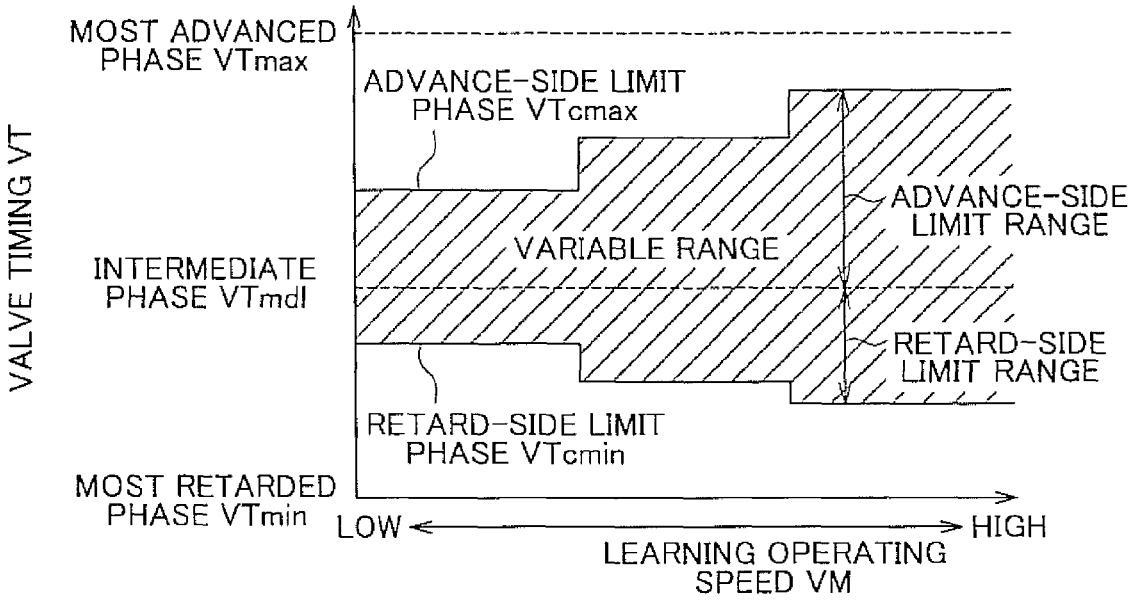
FIG. 8 is a map that illustrates the relationship between learning operating speed and variable range, which is referenced in the "operating speed learning control" executed by the electronic controller according to the embodiment.

The configuration of the variable range map is described with reference to FIG. 8. In the variable range map, the size of the portion of the variable range on the retard side with respect to the intermediate phase VTmdl (hereinafter, "retard-side limit range"), and the size of the portion of the variable range on the advance side with respect to the intermediate phase VTmdl (hereinafter, "advance-side limit range") are specified in accordance with the learning operating speed VM. Also, the retard-side limit range and the advance-side limit range are each specified so as to become larger in a step-wise manner as the learning operating speed VM increases.

Figure 9:
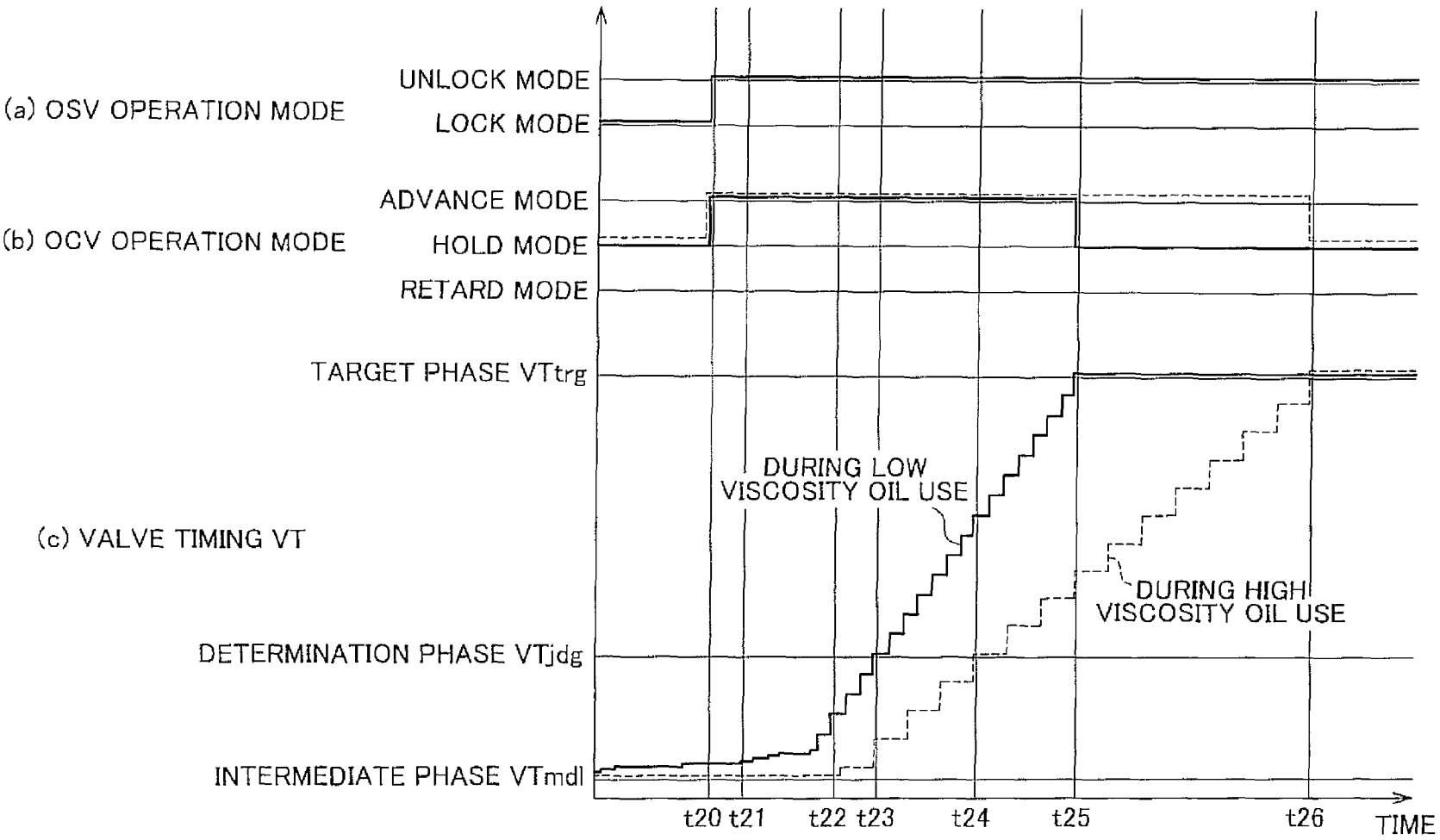
FIG. 9 is a timing chart that illustrates an example of the mode of execution of the "operating speed learning control" executed by the electronic controller according to the embodiment.

An example of the mode of execution of the operating speed learning control during low viscosity oil use and during high viscosity oil use is described with reference to FIG. 9. The solid lines in FIG. 9 indicate the mode of execution during low viscosity oil use. The broken lines in FIG. 9 indicate the mode of execution during high viscosity oil use. It is assumed that the oil temperature and the engine speed NE are the same between the two modes of execution.

The flow of operating speed learning control during low viscosity oil use is described below. At time t20, that is, when the accelerator pedal 2 is depressed, a phase advance request is set on the basis of this depression. As a result, the OSV operation mode is changed from the lock mode to the unlock mode. Also, the OCV operation mode is changed from the hold mode to the advance mode. In addition, the maximum advance speed is set in the advance mode.

At time t21, that is, when the lock pin 51, 61 has moved to the retracted position, the operational state of the valve timing changing mechanism 30 changes from the phase-locked state to the phase-unlocked state. Thus, the valve timing VT begins to advance toward the target phase VTtrg from the intermediate phase VTmdl.

At time t23, that is, when the valve timing VT has reached the determination phase VTjdg, the learning operating speed VM is calculated on the basis of the elapsed time from time t20 to time t23 and the engine speed NE.

At time t25, that is, when the valve timing VT has reached the target phase VTtrg, the OCV operation mode is changed from the advance mode to the hold mode. Subsequently, the valve timing VT is changed between the most advanced phase VTmax and the most retarded phase VTmin on the basis of the engine operation state.

The flow of operating speed learning control during high viscosity oil use is described below. At time t22, that is, when the lock pin 51, 61 has moved to the retracted position, the operational state of the valve timing changing mechanism 30 changes from the phase-locked state to the phase-unlocked state. Thus, the valve timing VT begins to advance toward the target phase VTtrg from the intermediate phase VTmdl.

At time t24, that is, when the valve timing VT has reached the determination phase VTjdg, the learning operating speed VM is calculated on the basis of the elapsed time from time t20 to time t24 and the engine speed NE.

At time t26, that is, when the valve timing VT has reached the target phase VTtrg, the OCV operation mode is changed from the advance mode to the hold mode. Subsequently, the valve timing VT is changed between the most advanced phase VTmax and the most retarded phase VTmin on the basis of the engine operation state.

As mentioned above, the period of time until the valve timing changing mechanism 30 changes from the phase-locked state to the phase-unlocked state after a phase advance request is set is shorter during low viscosity oil use (elapsed time from time t20 to t21) than during high viscosity oil use (elapsed time from time t20 to t22).

Also, the period of time until the valve timing VT reaches the determination phase VTjdg after the operational state of the valve timing changing mechanism 30 changes from the phase-locked state to the phase-unlocked state is shorter during low viscosity oil use (elapsed time from time t21 to t23) than during high viscosity oil use (elapsed time from time t22 to t24).

The sum of the above two time periods, that is, the period of time until the valve timing VT reaches the determination phase VTjdg after a phase advance request is set, is shorter during low viscosity oil use (elapsed time from time t20 to t23) than during high viscosity oil use (elapsed time from time t20 to t24).

The internal combustion engine 1 according to the embodiment provides the following advantages. (1) The electronic controller 81 limits the variable range in accordance with the learning operating speed VM of the valve timing changing mechanism 30. According to this configuration, the variable range is limited on the basis of the learning operating speed VM on which the difference in oil viscosity is reflected. Therefore, as compared with a case where the operation of the valve timing changing mechanism 30 is limited indiscriminately in the state when the oil temperature is low, it is possible to ensure a greater number of situations where the valve timing VT can be changed in accordance with the engine operation state.

(2) The electronic controller 81 makes the size of the retard-side limit range during high viscosity oil use smaller than the size of the retard-side limit range during low viscosity oil use. According to this configuration, when the valve timing VT is on the retard side with respect to the intermediate phase VTmdl during high viscosity oil use and while a phase limitation is executed, the maximum difference between the valve timing VT and the intermediate phase VTmdl is smaller than that during low viscosity oil use. As a result, when the valve timing VT is on the retard side with respect to the intermediate phase VTmdl, it is possible to reduce the frequency with which the engine stops without the operational state of the valve timing changing mechanism 30 being changed to the phase-locked state.

(3) The electronic controller 81 makes the size of the advance-side limit range during high viscosity oil use smaller than the size of the advance-side limit range during low viscosity oil use. According to this configuration, when the valve timing VT is on the advance side with respect to the intermediate phase VTmdl during high viscosity oil use and while a phase limitation is executed, the maximum difference between the valve timing VT and the intermediate phase VTmdl is smaller than that during low viscosity oil use. As a result, when the valve timing VT is on the advance side with respect to the intermediate phase VTmdl, it is possible to reduce the frequency with which the engine stops without the operational state of the valve timing changing mechanism 30 being changed to the phase-locked state.

(4) The torque of the intake camshaft 22 fluctuates in the advance direction and the retard direction. Also, the torque that acts in the retard direction is greater than the torque that acts in the advance direction. As a result, as compared with when retarding the valve timing VT, greater resistance is applied to the valve timing changing mechanism 30 when advancing the valve timing VT. Thus, the difference in the operating speed of the valve timing changing mechanism 30 due to the difference in oil viscosity is more easily detected at the time of advancing the valve timing VT than at the time of retarding the valve timing VT. Since the electronic controller 81 according to the above-mentioned embodiment learns the learning operating speed VM when advancing the valve timing VT, the frequency with which the operating speed of the valve timing changing mechanism 30 is learned appropriately increases.

(5) The electronic controller 81 learns the learning operating speed VM when the valve timing VT begins to advance. According to this configuration, the state in which the speed of change of the valve timing VT is "0" being taken as a reference, the learning operating speed VM is learned in accordance with the speed of change of the valve timing VT from this state. Therefore, as compared with a case where the state in which the speed of change of the valve timing VT is fluctuating is used as a reference in learning the learning operating speed VM, the frequency with which the learning operating speed VM is learned appropriately increases.

(6) The electronic controller 81 learns the learning operating speed VM in accordance with the operating speed of the valve timing changing mechanism 30, when the unlock conditions at startup are met and when a phase advance request is set. According to this configuration, as compared with a case where the valve timing changing mechanism 30 is operated in order to learn the learning operating speed VM, it is possible to reduce the frequency with which the valve timing VT is changed to a timing not suited for the engine operation state in the course of learning the learning operating speed VM.

In this embodiment, the learning operating speed VM is learned on the basis of a phase advance request made by depressing the accelerator pedal 2. Therefore, as compared with a case where the valve timing VT is changed in order to learn the learning operating speed VM, there is less fear that the driver may feel a sense of incongruity during the learning.

(7) The electronic controller 81 sets the advance speed of the valve timing VT by the oil control valve 72 to the maximum advance speed when learning the learning operating speed VM. According to this configuration, it is possible to prevent the time required for the valve timing VT to reach the target phase VTtrg from becoming long.

(8) In the internal combustion engine 1 that supplies hydraulic oil to the valve timing changing mechanism 30 by the torque of the crankshaft 15, the operating speed of the valve timing changing mechanism 30 varies with the engine speed NE. Since the electronic controller 81 according to the above-mentioned embodiment learns the learning operating speed VM by taking the engine speed NE into account, it is possible to reduce the influence of the engine speed NE on the learning operating speed VM. As a result, it is possible to learn the operating speed of the valve timing changing mechanism 30 on which the influence of the oil viscosity is reflected more appropriately.

The embodiment of the invention is not limited to the above-mentioned embodiment but may be modified as explained below, for example. The following modifications are not only applied to the above-mentioned embodiment but different modifications may be implemented in combination.

In the embodiment mentioned above (FIG. 8), the size of the retard-side limit range and the size of the advance-side limit range are increased in a stepwise manner with increase in the learning operating speed VM. In this regard, the advance-side limit phase VTcmax may be set to a constant value irrespective of the learning operating speed VM.

In the embodiment mentioned above (FIG. 8), the size of the advance-side limit range is increased with increase in the learning operating speed VM. In this regard, the size of the advance-side limit range may be decreased with increase in the learning operating speed VM. An example of the specific method for decreasing the advance-side limit range in this way is to make the amount of decrease in the size of the advance-side limit range with respect to the amount of increase in the learning operating speed VM greater than the amount of increase in the size of the retard-side limit range with respect the amount of increase in the learning operating speed VM. In this modification, the advantage (2) according to the above embodiment is attained because the retard-side limit range decreases with decrease in the learning operating speed VM.

In the embodiment mentioned above (FIG. 8), the size of the retard-side limit range is increased in a stepwise manner with increase in the learning operating speed VM. In this regard, the size of the retard-side limit range may be increased in a continuous manner with increase in the learning operating speed VM. For example, the retard-side limit phase VTcmin may be increased linearly with increase in the learning operating speed VM.

In the embodiment mentioned above (FIG. 8), the size of the advance-side limit range is increased in a stepwise manner with increase in the learning operating speed VM. In this regard, the size of the advance-side limit range may be increased in a continuous manner with increase in the learning operating speed VM. For example, the advance-side limit phase VTcmax may be increased linearly with increase in the learning operating speed VM.

In the embodiment mentioned above (FIG. 8), the size of the retard-side limit range and the size of the advance-side limit range are increased in a stepwise manner with increase in the learning operating speed VM. In this regard, the intermediate phase VTmdl may be set as the variable range when the learning operating speed VM is lower than a predetermined operating speed. In this case, the operational state of the valve timing changing mechanism 30 may be fixed to a fixed operational state.

In the embodiment mentioned above (FIG. 7), the condition that the coolant temperature TW be higher than or equal to a temperature indicative of the completion of warm-up is used as one of the learning conditions. In this regard, instead of this condition, a condition that the coolant temperature TW be lower than a temperature indicative of the completion of warm-up may be used as a learning condition.

In the embodiment mentioned above (FIG. 7), each of the conditions that the valve timing changing mechanism 30 be in the phase-locked state, and that the current state be idling is used as one of the learning conditions. In this regard, instead of these conditions, conditions that the valve timing changing mechanism 30 be in the phase-unlocked state, and that the current state be normal engine operation may be used as learning conditions.

In the embodiment mentioned above (FIG. 7), each of the conditions that the current state be idling, and that a phase advance request be set is used as one of the learning conditions. In this regard, instead of these conditions, conditions that the current state be normal engine operation, and that a phase retard request be set may be used as learning conditions. In this case, the learning operating speed VM is calculated on the basis of the period of time taken until a predetermined valve timing VT on the side more retarded than the valve timing VT at that time is reached.

In the embodiment mentioned above (FIG. 7), the learning operating speed VM is calculated in accordance with the engine speed NE. In this regard, the learning operating speed VM may be corrected on the basis of the coolant temperature TW at the time of performing the operating speed learning control. In this case, the learning operating speed VM increases with decrease in the coolant temperature TW.

In the embodiment mentioned above (FIG. 7), the maximum advance speed is set in the advance mode when learning the learning operating speed VM. In this regard, an advance speed lower than the maximum advance speed may be set.

In the embodiment mentioned above (FIG. 5), the phase limitation is canceled on the basis of the coolant temperature TW. In this regard, a "limiting period" as a period of time in which the size of the variable range is limited may be set, and the phase limitation may be canceled on the basis of the set limiting period. The limiting period is set so as to become shorter as the learning operating speed VM becomes higher. In this case, the size of the variable range to be limited may be set to a constant size irrespective of the learning operating speed VM.

Figure 10:
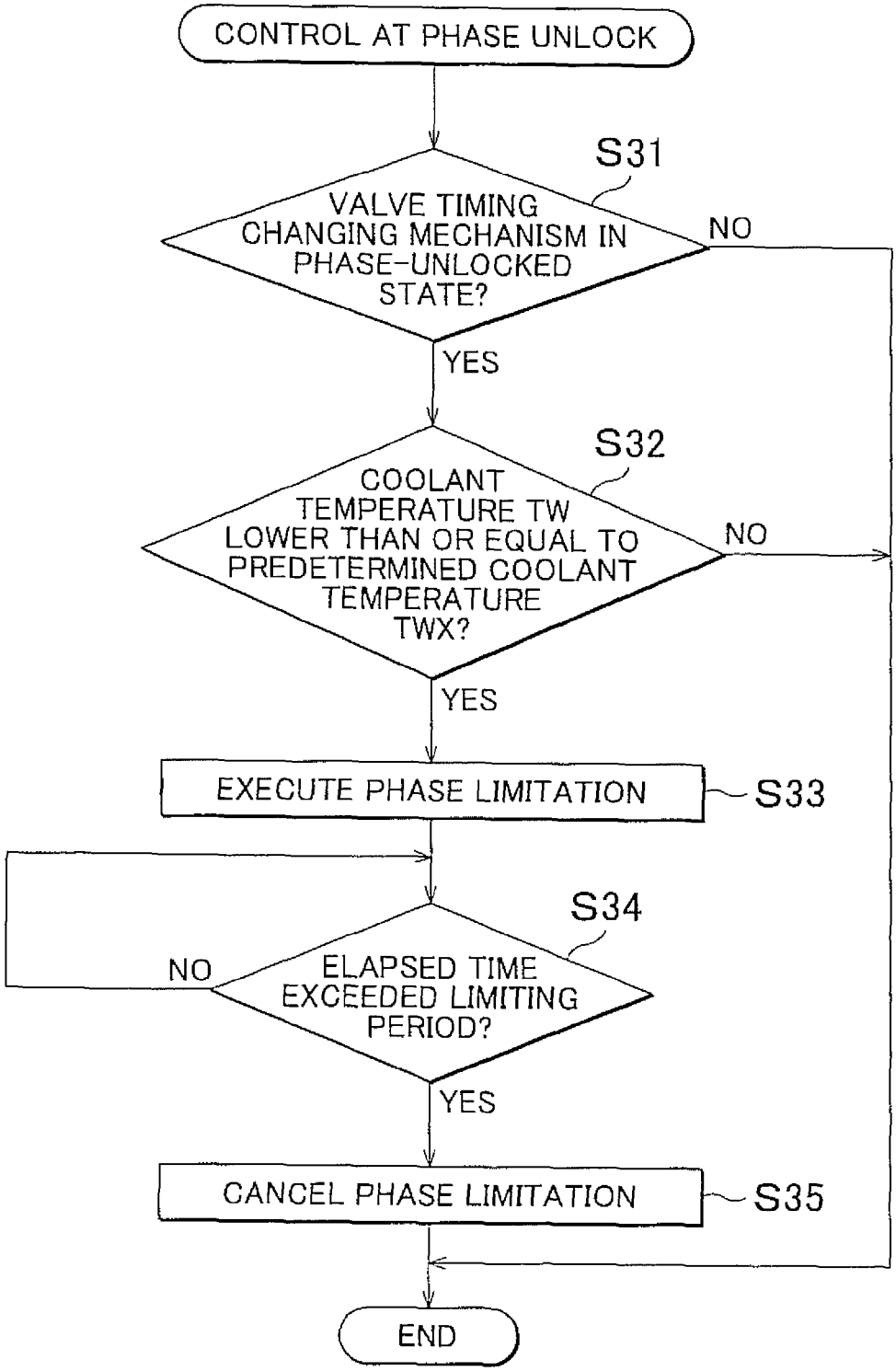
FIG. 10 is a flow chart that illustrates the procedure of a "control at phase unlock" executed by the electronic controller, with respect to a variable valve controller according to another embodiment of the invention.

A control at phase unlock using a limiting period is described with reference to FIG. 10. This control is executed by the electronic controller 81 every predetermined control period. That is, after the last step ends, execution of the same control is put on hold until a predetermined control period elapses, and upon elapse of the predetermined control period, the control at phase unlock is executed again from the first step.

When it is determined in step S31 that the valve timing changing mechanism 30 is in the phase-unlocked state, and it is determined in step S32 that the coolant temperature TW is lower than or equal to a predetermined coolant temperature TWX, a phase limitation is executed in step S33.

In step S34, it is determined whether or not the elapsed time since the start of execution of the phase limitation has exceeded a limiting period that is set in accordance with the learning operating speed VM. When it is determined that the elapsed time since the start of execution of the phase limitation has not exceeded the limiting period, the determination in step S34 is executed again after a predetermined period. On the other hand, when it is determined that the elapsed time since the start of execution of the phase limitation has exceeded the limiting period, the phase limitation is canceled in step S35.

In the embodiment mentioned above (FIG. 5), a phase limitation is executed when the coolant temperature TW is lower than or equal to a predetermined coolant temperature TWX. In this regard, the value of the predetermined coolant temperature TWX may be changed in accordance with the learning operating speed VM. In this case, the size of the variable range to be limited may be set to a constant size irrespective of the learning operating speed VM.

In the embodiment mentioned above (FIG. 7), the size of the variable range is set in accordance with the learning operating speed VM. In this regard, the size of the variable range may be set in the following manner. That is, an input unit may be provided to input at least one of the following pieces of information: the composition of hydraulic oil; the kind of hydraulic oil; and oil viscosity, to the electronic controller 81 upon replacing hydraulic oil. The size of the variable range is set on the basis of the inputted information. In this case, the following processing may be added. That is, the state of degradation of hydraulic oil is estimated on the basis of the elapsed time since replacement of hydraulic oil, and the size of the variable range is set by taking the estimated state of degradation into account.

In the embodiment mentioned above (FIG. 1), the mode of supply and discharge of hydraulic oil with respect to the advance chamber 37 and the retard chamber 38 is controlled by the oil control valve 72, and the mode of supply and discharge of hydraulic oil with respect to each of the unlock chambers 54, 64 is controlled by the oil switching valve 73. In this regard, a single oil control valve that controls the mode of supply and discharge of hydraulic oil with respect to the advance chamber 37, the retard chamber 38, and each of the unlock chambers 54, 64 may be provided.

In the embodiment mentioned above (FIG. 3), the first engaging groove 56 including the first lower groove 57 and the first upper groove 58 is defined in the first locking mechanism 50. In this regard, at least one of the following changes (A) and (B) may be made to the first engaging groove 56. (A) Instead of the first lower groove 57, a hole in which the first lock pin 51 is fitted is defined at a position corresponding to the first lock pin 51 in the intermediate rotation phase. In this case, the end of the first upper groove 58 is extended to the hole at the above-mentioned position. (B) The first upper groove 58 is omitted.

In the embodiment mentioned above (FIG. 3), the second engaging groove 66 including the second lower groove 67 and the second upper groove 68 is defined in the second locking mechanism 60. In this regard, at least one of the following changes (A) and (B) may be made to the second engaging groove 66. (A) Instead of the second lower groove 67, a hole in which the second lock pin 61 is fitted is defined at a position corresponding to the second lock pin 61 in the intermediate rotation phase. (B) The second upper groove 68 is omitted.

In the embodiment mentioned above (FIG. 3), the first lock pin 51 and the second lock pin 61 are provided in the vane rotor 35, and the first engaging groove 56 and the second engaging groove 66 are defined in the housing rotor 31. In this regard, the configurations of the lock pins 51, 61 and engaging grooves 56, 66 may be changed as explained below. That is, at least one of the first engaging groove 56 and the second engaging groove 66 may be defined in the vane rotor 35, and at least one of the first lock pin 51 and the second lock pin 61 may be provided in the housing rotor 31.

In the embodiment mentioned above (FIG. 2), the valve timing locking mechanism 40 employed is configured so that the first lock pin 51 and the second lock pin 61 move in the axial direction with respect to the vane 35A. In this regard, the configuration of the lock pins 51, 61 may be changed as explained below. That is, the valve timing locking mechanism 40 may be configured so that at least one of the first lock pin 51 and the second lock pin 61 moves so as to project or retract in the radial direction with respect to the vane 35A. In this case, in accordance with the movement of the first lock pin 51 and the second lock pin 61 with respect to the vane 35A, at least one of an engaging groove corresponding to the first engaging groove 56, and an engaging groove corresponding to the second engaging groove 66 is defined in the housing rotor 31.

In the embodiment mentioned above (FIG. 4), the valve timing VT to be locked by the valve timing locking mechanism 40 is set to the intermediate phase VTmdl. In this regard, alternatively, a valve timing VT other than the intermediate phase VTmdl may be set as the valve timing VT to be locked by the valve timing locking mechanism 40.

The configuration of the variable valve device controller according to the invention is not limited to the configuration according to the above-mentioned embodiment. That is, the variable valve device controller to which the invention can be applied may have any configuration as long as the variable valve device controller includes a phase changing mechanism and a phase locking mechanism. In that case as well, advantages similar to those of the above-mentioned embodiment are attained.

While the invention has been described with reference to example embodiments thereof, it is to be understood that the invention is not limited to the described example embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

What is claimed is:

1. A controller for a variable valve device of an internal combustion engine, the variable valve device including a phase changing mechanism of a hydraulic type that changes valve timing, and a phase locking mechanism that locks the valve timing to a predetermined specific phase, comprising:

a limiting control unit configured to execute a limiting control that limits an operation of the phase changing mechanism, wherein an operational state of the phase changing mechanism in which the valve timing is locked to the predetermined specific phase is defined as a phase-locked state, the predetermined specific phase is a phase between a most retarded phase and a most advanced phase;

an operational state of the phase changing mechanism in which the valve timing can be changed is defined as a phase-unlocked state;

a range defined by two different phases and over which the valve timing can be changed when the phase changing mechanism is in the phase-unlocked state is defined as a variable range;

a temperature of a hydraulic oil in the phase changing mechanism is defined as an oil temperature;

a viscosity of the hydraulic oil in the phase changing mechanism is defined as an oil viscosity;

a state in which the oil temperature is within a predetermined temperature range is defined as a predetermined oil temperature state;

a predetermined phase located on a retard side with respect to the predetermined specific phase within a range from the most retarded phase to the predetermined specific phase is defined as a retard-side limit phase;

a range from the predetermined specific phase to the retard-side limit phase is defined as a retard-side limit range, the retard-side limit range is included in the variable range; and in the limiting control, the limiting control unit sets the retard-side limit range in the predetermined oil temperature state, when the oil viscosity is high, to a size smaller than a size of the retard-side limit range in the predetermined oil temperature state, when the oil viscosity is low.

2. The controller for a variable valve device according to claim 1, wherein:

in the limiting control, the limiting control unit sets the variable range in the predetermined oil temperature state, when the oil viscosity is high, to a size smaller than a size of the variable range in the predetermined oil temperature state, when the oil viscosity is low.

3. The controller for a variable valve device according to claim 1, wherein:

in the limiting control, the limiting control unit changes a limiting period in which the limiting control is executed, in accordance with at least one of a composition and the viscosity of the hydraulic oil.

4. The controller for a variable valve device according to claim 3, wherein the limiting control unit makes the limiting period in the predetermined oil temperature state, when the oil viscosity is high, longer than the limiting period in the predetermined oil temperature state, when the oil viscosity is low.

5. The controller for a variable valve device accordingly to claim 1, wherein the two different phases are the most advanced phase and the most retarded phase.

6. A controller for a variable valve device of an internal combustion engine, the variable valve device including a phase changing mechanism of a hydraulic type that changes valve timing, and a phase locking mechanism that locks the valve timing to a predetermined specific phase, comprising:

a limiting control unit configured to execute a limiting control that limits an operation of the phase changing mechanism, wherein an operational state of the phase changing mechanism in which the valve timing is locked to the predetermined specific phase is defined as a phase-locked state, the predetermined specific phase is a phase between a most retarded phase and a most advanced phase;

an operational state of the phase changing mechanism in which the valve timing can be changed is defined as a phase-unlocked state;

a range defined by two different phases and over which the valve timing can be changed when the phase changing mechanism is in the phase-unlocked state is defined as a variable range; and a temperature of a hydraulic oil in the phase changing mechanism is defined as an oil temperature;

a viscosity of the hydraulic oil in the phase changing mechanism is defined as an oil viscosity;

a state in which the oil temperature is within a predetermined temperature range is defined as a predetermined oil temperature state;

the predetermined specific phase is a phase between a most retarded phase and a most advanced phase;

a predetermined phase located on a retard side with respect to the predetermined specific phase within a range from the most retarded phase to the predetermined specific phase is defined as a retard-side limit phase;

a predetermined phase located on an advance side with respect to the predetermined specific phase within a range from the most advanced phase to the predetermined specific phase is defined as an advance-side limit phase;

a range from the predetermined specific phase to the retard-side limit phase is defined as a retard-side limit range;

a range from the predetermined specific phase to the advance-side limit phase is defined as an advance-side limit range;

the retard-side limit range and the advance-side limit range are included in the variable range; and in the limiting control, the limiting control unit sets the retard-side limit range and the advance-side limit range in the predetermined oil temperature state, when the oil viscosity is high, to a size smaller than sizes of the retard-side limit range and the advance-side limit range in the predetermined oil temperature state, when the oil viscosity is low.

* * * * *